US007499064B2

(12) United States Patent
Ota

(10) Patent No.: US 7,499,064 B2
(45) Date of Patent: Mar. 3, 2009

(54) DISPLAY SYSTEM, DATA DRIVER, AND DISPLAY DRIVE METHOD FOR AVOIDING DEGRADATION OF DISPLAY QUALITY

(75) Inventor: Yusuke Ota, Fujimi-machi (JP)

(73) Assignee: Seiko Epson Corporation (JP)

( * ) Notice: Subject to any disclaimer, the term of this patent is extended or adjusted under 35 U.S.C. 154(b) by 593 days.

(21) Appl. No.: 10/807,540

(22) Filed: Mar. 23, 2004

(65) Prior Publication Data

US 2004/0233228 A1 Nov. 25, 2004

(30) Foreign Application Priority Data

Mar. 24, 2003 (JP) ..... 2003-080149

(51) Int. Cl.
*G09G 5/10* (2006.01)

(52) U.S. Cl. ..... 345/690; 345/89

(58) Field of Classification Search ..... 345/92, 345/94, 96, 98, 100, 690, 89
See application file for complete search history.

(56) References Cited

U.S. PATENT DOCUMENTS

| | | | | |
|---|---|---|---|---|
| 6,067,083 | A * | 5/2000 | Glen et al. | 345/213 |
| 6,819,310 | B2 * | 11/2004 | Huang et al. | 345/97 |
| 7,173,599 | B2 * | 2/2007 | Nishimura | 345/102 |
| 2002/0093480 | A1 * | 7/2002 | Mizutani et al. | 345/102 |
| 2003/0189539 | A1 * | 10/2003 | Tamura | 345/89 |

FOREIGN PATENT DOCUMENTS

| | | |
|---|---|---|
| JP | 09-269476 | 10/1997 |
| JP | 2001-075541 | 3/2001 |
| JP | 2001-272940 | 10/2001 |
| JP | 2002-156946 | 5/2002 |
| JP | 2002-221944 | 8/2002 |
| JP | 2003-015610 | 1/2003 |
| JP | 2004-191697 | 7/2004 |

OTHER PUBLICATIONS

Communication from Japanese Patent Office regarding counterpart application.
Communication from Japanese Patent Office regarding counterpart application, 2003.

* cited by examiner

*Primary Examiner*—Chanh Nguyen
*Assistant Examiner*—Calvin C Ma
(74) *Attorney, Agent, or Firm*—Harness, Dickey & Pierce, P.L.C.

(57) ABSTRACT

A display system is provided having an active matrix type display panel and includes first and second frame synchronization circuits and an OFF data output control circuit that output a display control signal, a scan control signal, and an OFF data output control signal based on display stopping signals for stopping image display. The data driver drives the data lines of the display panel, based on the OFF data output control signal, during a predetermined frame period that includes the second frame (the next after the first, which is the frame where the display stopping signal is input), then outputs a predetermined non-display voltage after the frame period ends. A scan driver scans scan lines of the display panel based on the scan control signal, and outputs the non-selecting voltage to all of the scan lines after the frame period ends.

10 Claims, 19 Drawing Sheets

DISPLAY SYSTEM, DATA DRIVER, AND DISPLAY DRIVE METHOD FOR AVOIDING DEGRADATION OF DISPLAY QUALITY

RELATED APPLICATIONS

This application claims priority to Japanese Patent Application No. 2003-080149 filed Mar. 24, 2003 which is hereby expressly incorporated by reference herein.

BACKGROUND

1. Field of the Invention

The present invention relates to a display system, a data driver, and a display drive method.

2. Description of the Related Art

As for a typical display system, there is a liquid crystal (LC) display system. An LC display system includes an LC panel (display panel; more broadly, an electro-optic device), a scan driver that scans scan lines (scan electrodes) of the LC panel, and a data driver that drives data lines (data electrodes) of the LC panel. The LC drive methods available for the LC panel include the passive matrix drive method and the active matrix drive method. The passive matrix drive method is used to drive a passive matrix type LC panel, of which an STN (super twisted neumatic) mode LC panel is a typical example, while the active matrix drive method is used to drive an active matrix type LC panel, in which a TFT (thin film transistor) or TFD (thin film diode) is provided for each pixel or dot.

In a passive matrix type LC panel, voltage is applied to the data lines via sequential selection of the scan lines. A selecting voltage is applied to the scan lines that are selected, and a non-selecting voltage is applied to the scan lines that are not selected. Accordingly, with the passive matrix method, voltage is applied to the selected pixels and to the non-selected pixels.

In an active matrix type LC panel also, voltage is applied to the data lines via sequential selection of the scan lines. But scan lines with non-selected pixels are not selected, so that voltage is not necessarily applied to non-selected pixels.

During drive periods, a display stopping signal such as an initializing signal (reset signal) may be input. At this time, even scanning in the vertical scan direction is stopped midway, voltage is applied constantly to both the selected and the non-selected pixels in the passive matrix method. Therefore, the voltage applied to all of the pixels can be rendered close to zero by applying the non-selecting voltage to all of the scan lines and to all of the data lines.

In contrast, in the active matrix method, the data line voltage can be applied to the selected pixels but cannot be applied to the non-selected pixels. Therefore, when scanning in the vertical scan direction is stopped midway, the electric charges held in the pixels are gradually discharged and the displayed image of the LC panel blurs, resulting in degradation of the display quality.

The present invention has been made in consideration of the above-described technical problem, and a purpose is to provide a display system, a data driver and a display drive method that avoid degradation of display quality due to input of display stopping signals during drive periods in the active matrix type electro-optic device.

SUMMARY

In order to solve the above-described problem, the present invention relates to a display system including an active matrix type display panel, a data driver that drives data lines of the display panel, and a scan driver that scans the scan lines of the display panel, wherein when a display stopping signal (for stopping image display of the display panel) is input:

the data driver outputs a drive voltage corresponding to a predetermined gray scale value to the data lines during a frame period that includes the second frame and subsequent frames (the second frame being the next after the first frame where the display stopping signal is input), then outputs non-display voltage to the data lines after the frame period ends; and the scan driver outputs selecting voltage to the scan lines and scans them during the first frame and the frame period, then outputs non-selecting voltage to all of the scan lines after the frame period ends.

The "frame period" means the period from the second frame up to the $n^{th}$ frame (n being an integer of two or more). "The $n^{th}$ frame" means the next frame after the $(n-1)^{th}$ frame.

According to the present invention, when a display stopping signal is input, scanning by the scan driver does not stop during the first frame (the frame where the display stopping signal is input) nor during the frame period that includes the second frame and subsequent frames (the second frame being the next after the first frame). The data driver outputs a drive voltage corresponding to a predetermined gray scale value to the data lines during the frame period, then outputs a non-display voltage to the data lines after the frame period ends. Thus, in the first frame, the displayed image remains as it is. Then in the ensuing frame period, which includes the second frame, the above-described drive voltage is applied to the pixels of the active matrix type display panel. In this way, it is possible to avoid the degradation of display quality caused by progressive blurs of an image resulting from discharge of the electric charges corresponding to the display data for the image being scanned with an interruption of scanning during the vertical scanning of the active matrix type display panel.

The present invention further relates to a display system including an active matrix type display panel, a data driver that drives data lines of the display panel, and a scan driver that scans the scan lines of the display panel, and further including:

a first frame synchronization circuit that outputs a display control signal, which synchronizes the display stopping signal (for stopping image display of the display panel) with a frame pulse that specifies a vertical scan period of the display panel;

a second frame synchronization circuit that outputs a scan control signal, which synchronizes the display control signal with the frame pulse; and an OFF data output control circuit that outputs an OFF data control signal (for outputting a drive voltage corresponding to a predetermined gray scale value) to the data lines during a frame period that includes the second frame and subsequent frames (the second frame being the next after the first frame where the display stopping signal is input) based on the display control signal;

wherein the data driver outputs the drive voltage to the data lines based on the OFF data output control signal during the frame period, then outputs the non-display voltage to the data lines after the frame period ends; and the scan driver outputs the selecting voltage to the scan lines and scans them based on the scan control signal during the first frame and the frame period, then outputs the non-selecting voltage to all of the scan lines after the frame period ends.

In the present invention, the display control signal and scan control signal are generated by the first and second frame synchronization circuits, and the OFF data output control signal is generated by the OFF data output control circuit based on the display control signal. The OFF data output control signal is output during the frame period, which includes the second frame and subsequent frames (the second frame being the next after the first frame where the display stopping signal is input).

Thus, even when a display stopping signal is input, scanning by the scan driver is not interrupted during the first frame (the frame where the display stopping signal is input) and the frame period, which includes the second frame and subsequent frames (the second frame being the next after the first frame). Furthermore, during the frame period, the data driver outputs a drive voltage corresponding to a predetermined gray scale value to the data lines, then outputs non-display voltage to the data lines after the frame period ends. This means that the displayed image is displayed as it is during the first frame, while the drive voltage is applied to pixels of the active matrix type display panel during the frame period, which includes the ensuing second frame. In this way, it is possible to avoid the degradation of display quality caused by progressive blurs of an image resulting from discharge of the electric charges corresponding to the display data for the image being scanned with an interruption of scanning during the vertical scanning of the active matrix type display panel.

Furthermore, the control signal, for controlling the data driver and scan driver when a display stopping signal is input, can be generated by a simple circuit.

Moreover, in the display system of the present invention, the display stopping signal may be an initializing signal for the data driver, or a sleep signal that sets a sleep state, in which the drive for the data lines is stopped.

According to the present invention, even when an initializing signal or a sleep signal is input, a display system, which is able to avoid the degradation of display quality caused by progressive blurs of an image resulting from discharge of the electric charges corresponding to the display data for the image being scanned, can be provided.

Furthermore, in the display system of the present invention, the drive voltage corresponding to the predetermined gray scale value may be a drive voltage corresponding to a gray scale value of 0.

According to the present invention, the above-described effects are obtained, and a display system, in which generation of the drive voltage used to drive the data lines during the frame period is simplified, can be provided.

The present invention still further relates to a data driver for driving the data lines of an active matrix type display panel, including:

a first frame synchronization circuit that outputs a display control signal, which synchronizes a display stopping signal (for stopping image display of the display panel) with a frame pulse that specifies a vertical scan period of the display panel;

a second frame synchronization circuit that outputs a scan control signal, which synchronizes the display control signal with the frame pulse;

an OFF data output control circuit that outputs an OFF data control signal (for outputting a drive voltage corresponding to a predetermined gray scale value) to the data lines, based on the display control signal, during a frame period that includes the second frame and subsequent frames (the second frame being the next after the first frame where the display stopping signal is input); and a drive circuit that outputs the drive voltage corresponding to a predetermined gray scale value to the data lines, wherein, based on the OFF data output control signal, the drive circuit outputs the drive voltage to the data lines during the frame period, then outputs the non-display voltage to the data lines after the frame period ends.

Furthermore, in the data driver of the present invention, the scan control signal is output to the scan driver that scans signal lines of the display panel, and based on the scan control signal, the scan driver can output the selecting voltage to the scan lines and scan them during the first frame and the frame period, then output the non-selecting voltage to all of the scan lines after the frame period ends.

Moreover, with the data driver of the present invention, the display stopping signal may be an initializing signal for the data driver, or a sleep signal that sets a sleep state, in which the drive for the data lines is stopped.

Furthermore, with the data driver of the present invention, the drive voltage corresponding to the predetermined gray scale value may be a drive voltage corresponding to a gray scale value of 0.

The present invention further relates to a display drive method for a display system including an active matrix type display panel, a data driver that drives data lines of the display panel, and a scan driver that scans the scan lines of the display panel, wherein when a display stopping signal (for stopping image display of the display panel) is input, the data driver outputs a drive voltage corresponding to a predetermined gray scale value to the data lines during a frame period that includes the second frame and subsequent frames (the second frame being the next after the first frame where the display stopping signal is input); the scan driver outputs the selecting voltage to the scan lines and scans them during the first frame and the frame period; and after the frame period ends, the data driver outputs the non-display voltage to the data lines, while the scan driver outputs the non-selecting voltage to all of the scan lines.

DETAILED DESCRIPTION

Hereinafter, preferred embodiments of the present invention will be described in detail with reference to the drawings. The embodiments described below should not be construed to unduly limit the scope of the present invention as set forth in the claims. Nor do all the configurations described below necessarily represent essential configurational requirements for the present invention.

1. Display System

Figure 1A:
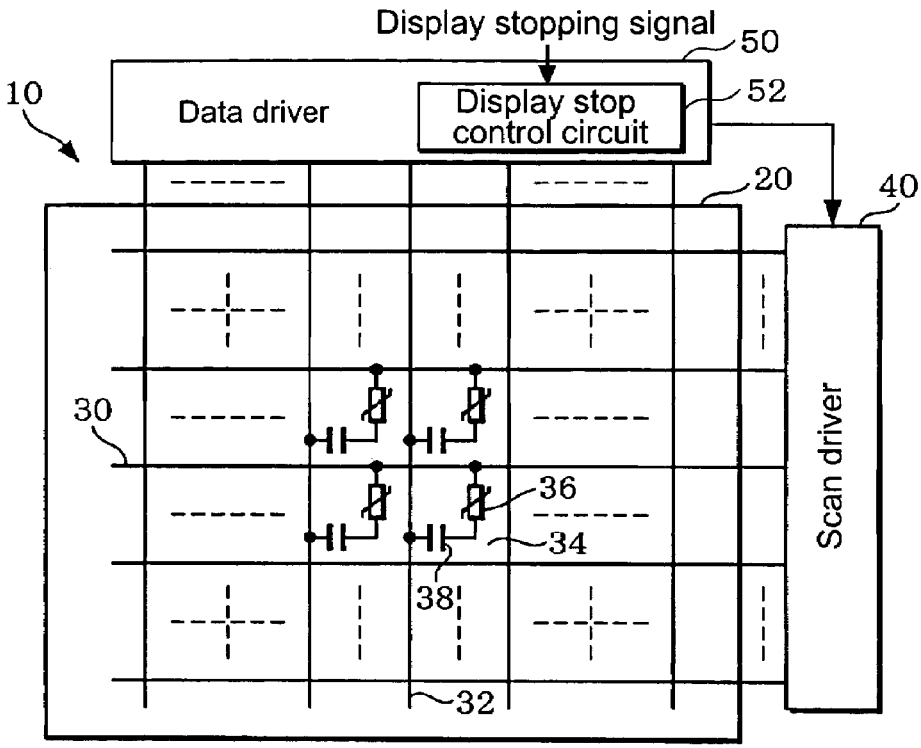
FIGS. 1(A) and (B) show equivalent circuit diagrams of example configurations of a display system.
Figure 1B:
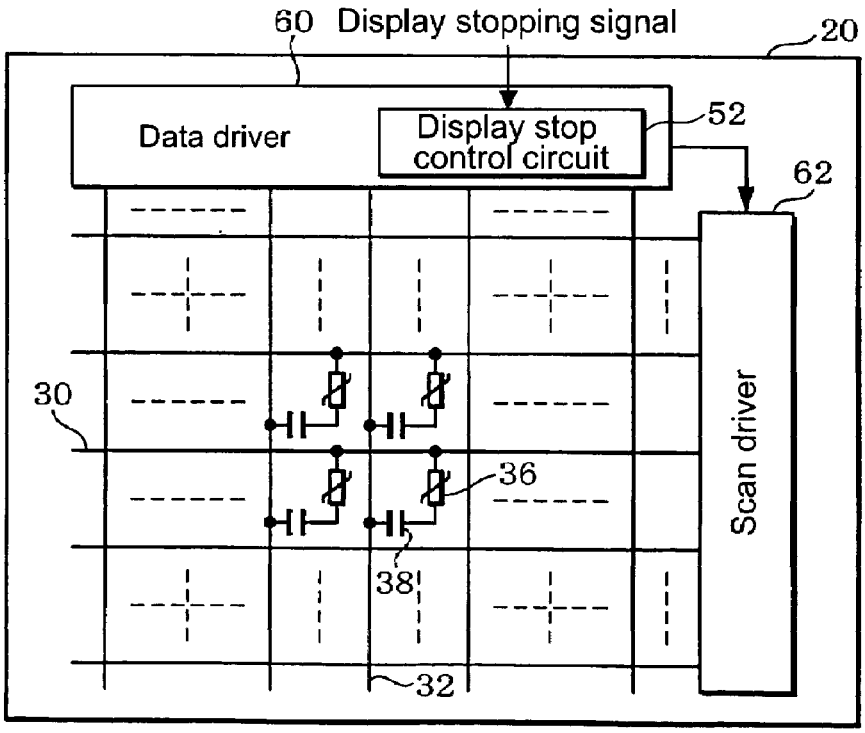

FIGS. 1(A) and (B) show equivalent circuits for example configurations of a display system 10. The display system 10 includes a display panel 20. As shown in FIG. 1 (A), an active matrix type display panel employing a TFD (more broadly, two-terminal nonlinear element) can be used for the display panel 20.

The display panel 20 includes a plurality of multiple scan lines 30 and a plurality of multiple data lines 32. The plurality of multiple scan lines 30 are scanned by a scan driver 40. The plurality of multiple data lines 32 are driven by a data driver 50. Within each pixel domain 34, a TFD 36 and an electro-optic material (liquid crystal) 38 are coupled in series between each of the scan lines 30 and the data lines 32.

In the display panel 20, display operation is controlled by switching the electro-optic material 38 among a display state, a non-display state and an intermediate state based on signals that are applied to the scan lines 30 and the data lines 32. Although in FIG. 1(A), the TFD 36 is coupled to the scan line 30 and the electro-optic material 38 is coupled to the data line 32, the opposite configuration, in which the TFD 36 is coupled to the data line 32 and the electro-optic material 38 is coupled to the scan line 30, is possible.

The data driver 50 includes a display stop control circuit 52. Into the display stop control circuit 52, a display stopping signal for stopping the image display of the display panel 20 is input. As for the display stopping signal, for example, a reset signal as an initializing signal generated by pressing a button by a user, or a signal such as a sleep signal generated based on command, which is set by an external host such as an MPU, is used.

Based on a control signal from the display stop control circuit 52, the data driver 50 outputs a drive voltage that corresponds to a predetermined gray scale value (such as gray scale value 0) to the data lines 32 during a frame period that includes the second frame and subsequent frames (the second frame being the next after the first frame where the display stopping signal is input). After the frame period ends, the data driver 50 outputs a predetermined non-display voltage to the data lines 32, based on the control signal from the display stop control circuit 52.

Furthermore, based on the control signal from the display stop control circuit 52, the scan driver 40 outputs a predetermined selecting voltage to the scan lines 30, and scans them during the first frame and the above-described frame period, then outputs a predetermined non-selecting signal to all of the scan lines 30 after the above-described frame period ends.

As shown in FIG. 1 (B), the display panel may also be configured so that at least one of a data driver 60 and a scan driver 62 is formed on the glass substrate, on which the pixels are formed. The data driver 60 has similar functions to the data driver 50, and includes a display stop control circuit 52. The scan driver 62 has similar functions to the scan driver 40. For example, the display panel 20 includes the plurality of scan lines 30, the plurality of data lines 32, the plurality of pixels coupled between the plurality of scan lines 30 and plurality of data lines 32, the scan driver 62 that scans the plurality of scan lines 30, and the data driver 60 that drives the plurality of data lines 32. In such a case, the display panel 20 can be termed as an electro-optic device, and with a drastic reduction of the packaging area, it can contribute to compactness and light-weight of electronic equipment.

In FIGS. 1(A) and (B), the active matrix type panel employs TFD, but it is by no means limited to those, and may be an active matrix panel employing a three-terminal element such as TFT or another type of a two-terminal element.

Figure 2C:
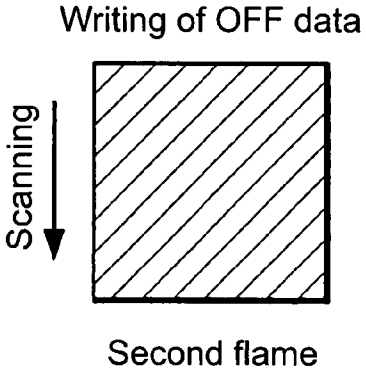
FIGS. 2(A), (B) and (C) show explanatory views of a display stop control in a display system.
Figure 2B:
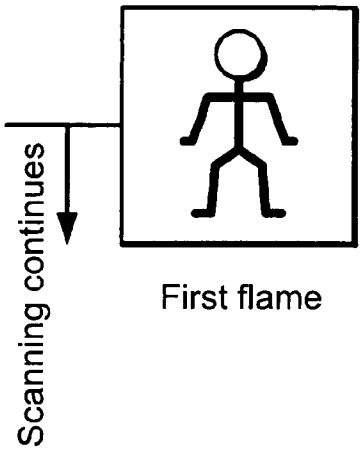
Figure 2A:
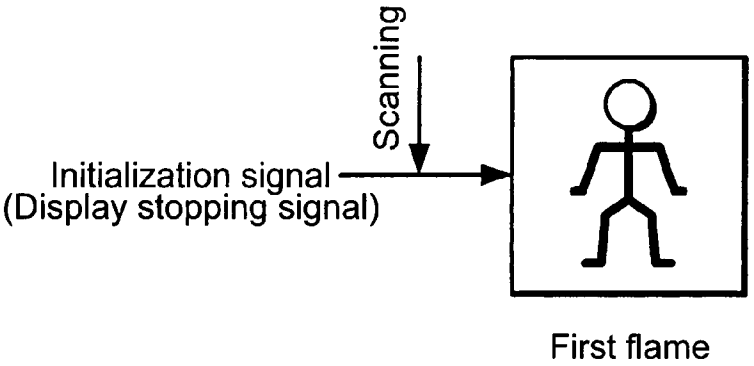

FIGS. 2(A), (B) and (C) show explanatory view of the display stop control according to the display system 10. When an initializing signal serving as a display stopping signal is input during a vertical scan period of the first frame shown in FIG. 2(A), scanning is continued by the data driver 50 so as to complete vertical scanning of the first frame (FIG. 2 (B)). Thus, with or without the input of a display stop signal, scanning of the scan lines 30 by the scan driver 40 and driving of the data lines 32 by the data driver 50 are conducted for the first frame.

Then, as shown in FIG. 2(C), during the period of one or a plurality of frames that includes the second frame (the next after the first frame), scanning of the data lines 30 is conducted by the scan driver 40 as in the first frame, and concurrently a non-display voltage based on the OFF data is input to the data lines 32 by the data driver 50. In this way, the electric charges that have accumulated in the pixels of the display panel 20 can be replaced with charges corresponding to the OFF data. As for the OFF data, for example, display data corresponding to gray scale value 0 can be used.

After the above-described frame period, which includes the second frame in FIG. 2(C), has ended, the scan driver 40 outputs the non-selecting voltage to all of the scan lines 30. As a result, with a condition that the OFF data are written in pixels of the display panel 20, scanning by the scan driver 40 and driving by the data driver 50 can be stopped.

Thus, as for the display system 10, scanning of scan lines of a frame is not interrupted midway of the frame, to which a display stopping signal is input. OFF data are written into the next frame of the frame to stop driving the display panel 20 and stop its image display. In this way, the degradation of the display quality due to the blurring of an image of the display panel caused by gradual escape of the electric charges held in the pixels, can be avoided.

Figure 3:
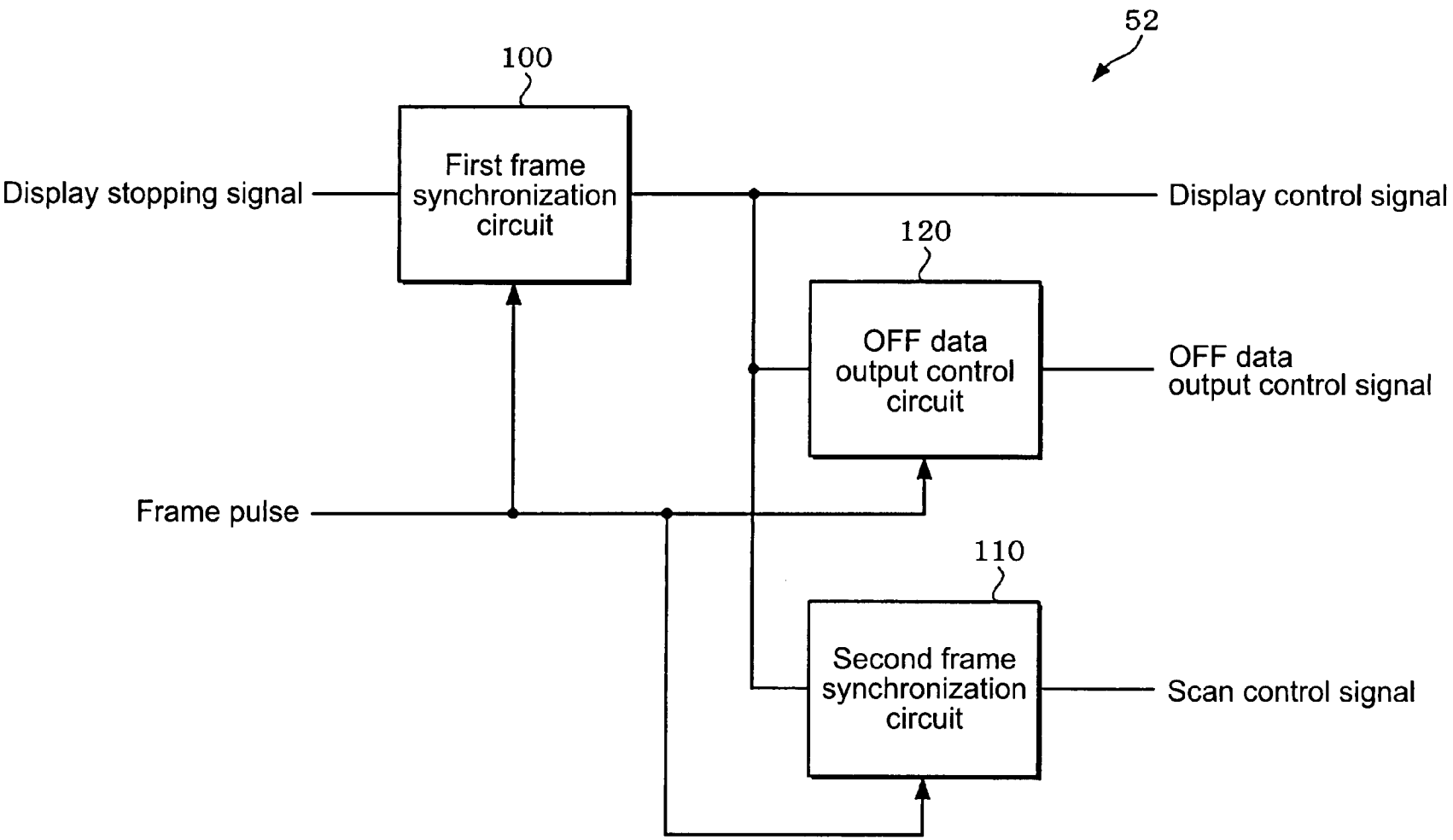
FIG. 3 shows a block diagram illustrating an outline of basic configuration of a display stop control circuit.

FIG. 3 shows a schematic configuration of the display stop control circuit 52, which includes first and second frame synchronization circuits 100, 110 and an OFF data output control circuit 120.

The first frame synchronization circuit 100 outputs a display control signal, which synchronizes the display stopping signal to the frame pulse that specifies the vertical scanning period for the display panel 20. The second frame synchronization circuit 110 output a scan control signal, which synchronizes the display control signal to the frame pulse. Based on the display control signal, the OFF data output control circuit 120 outputs an OFF data output control signal for outputting a drive voltage corresponding to a predetermined gray scale value (for example, gray scale value of 0) to the data lines during a predetermined frame period. The OFF data output control signal specifies a frame period of one or a plurality of frames that includes the next frame after the frame where the display stopping signal is input.

The following description assumes that the display control circuit 52 is included in the data driver 50, but the system may be configured so that the display control circuit 52 is included in a controller that controls at least one of the scan driver 40 and the data driver 50.

Figure 4:
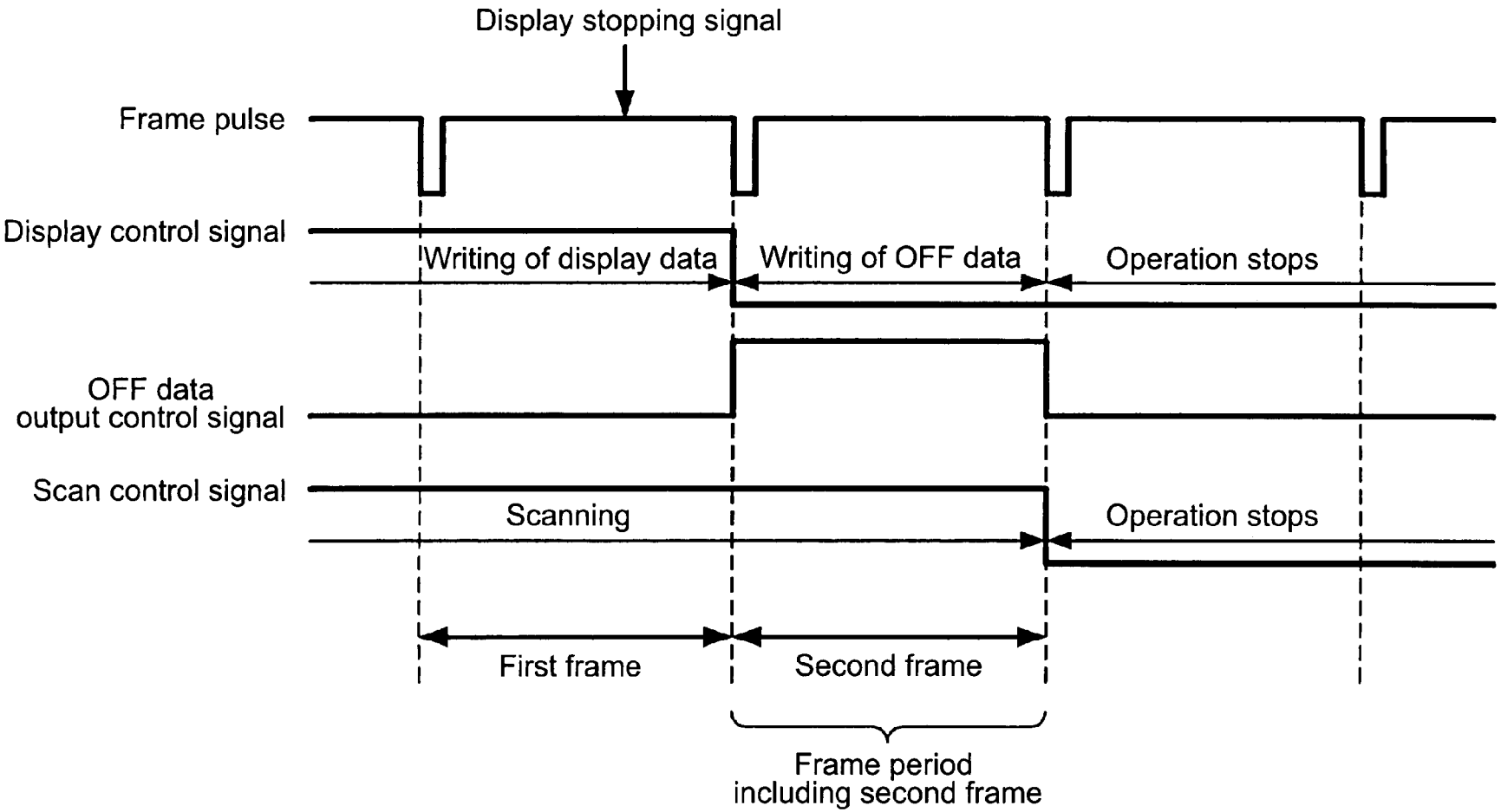
FIG. 4 shows a timing diagram of an example operation of a display stop control circuit.

FIG. 4 shows a timing diagram for an example of operation of the display stop control circuit 52. In FIG. 4, the frame period including the second frame (the next after the first frame where the display stopping signal is input) is a single-frame period, but it may be a plurality of frame periods.

Based on the display control signal, the data driver 50 outputs a drive voltage corresponding to the display data to the data lines 32. The display control signal, which is synchronized to the next frame after the one where the display stopping signal is input, changes from the "H" level to the "L" level in the second frame. With the display control signal of the level "L", the data driver 50 can stop the output of drive voltage corresponding to the display data.

The OFF data output control signal changes to the "H" level for just the length of the one or a plurality of frame periods, following the fall of the display control signal. During the frame period, which is specified by the OFF data output control signal changed to the "H" level, the data driver 50 outputs a drive voltage corresponding to a gray scale value of 0 to the data lines 32.

The "H" level of the scan control signal is held during the first frame (the frame where the display stopping signal is input) and the frame period that includes the second frame (the next after the first frame). After the frame period ends, the scan control signal changes to the "L" level. The scan driver 40 can scan the scan lines 30 when the scan control signal is at the "H" level, and stop scanning the scan lines 30 when the scan control signal is at the "L" level. The scan driver 40, which has stopped scanning, outputs a predetermined non-selecting voltage to all of the scan lines 30.

Example configurations of the scan driver 40 and the data driver 50, which are controlled by the above-described display stop control circuit 52, will be described hereinafter.

1.1 Scan Driver

Figure 5:
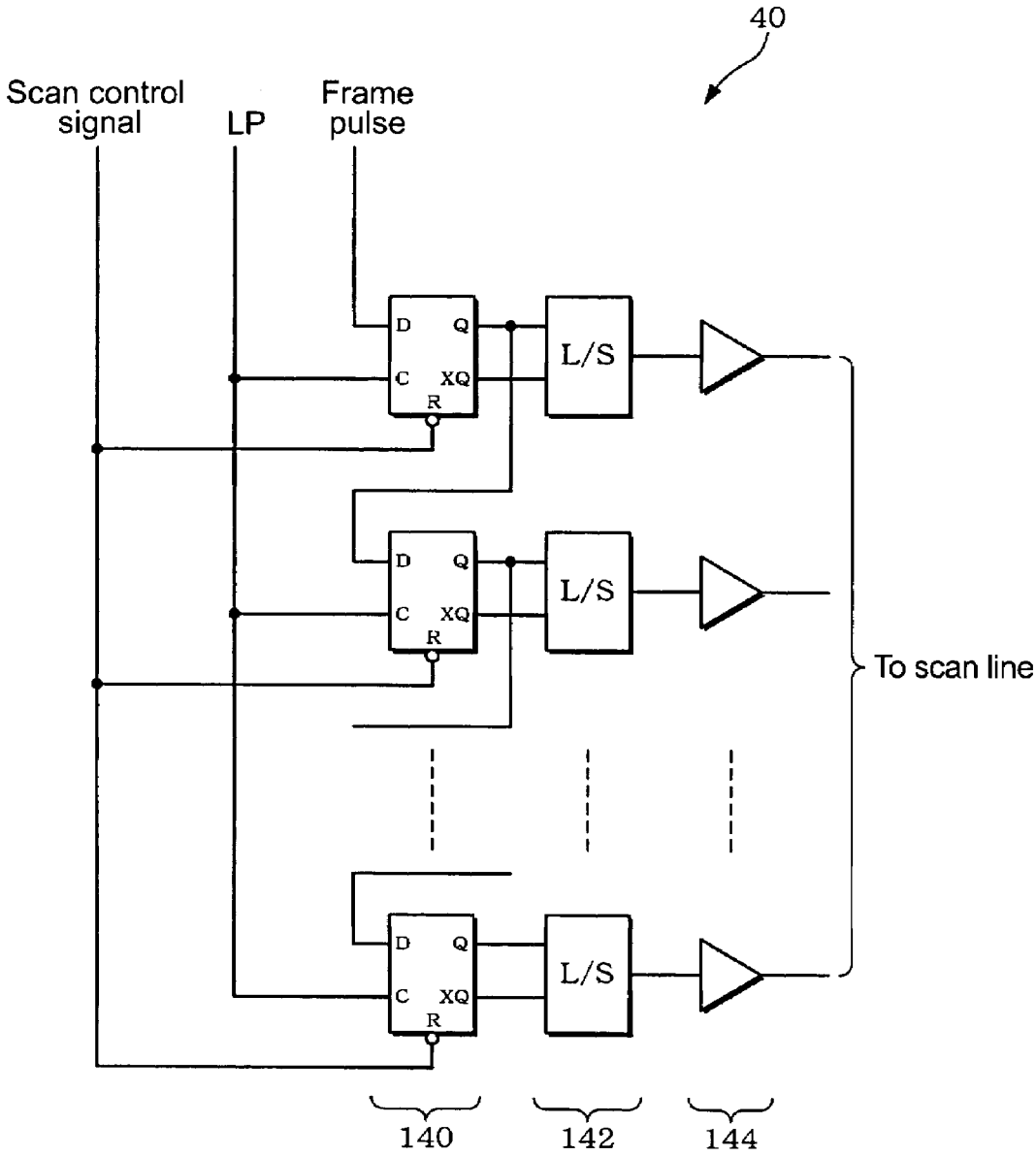
FIG. 5 shows a circuit diagram illustrating an example configuration of a scan driver.

FIG. 5 shows an example configuration of the scan driver 40. The scan driver 40 includes a shift register 140 that includes a plurality of flip-flops (FF), in which each FF corresponds to each scan line. The scan driver 40 further includes a plurality of level shifters (L/S) 142, in which each L/S corresponds to each FF, and a plurality of buffers 144, in which each buffer is connected to the output of each L/S.

Each FF includes a clock (C) terminal, a data input (D) terminal, a data output (Q) terminal, an inverted data output (XQ) terminal, and a reset (R) terminal. In synchronization with the rising of the input signal at the clock terminal, the FF takes in and retains the input signal at the data input terminal and outputs it via the data output terminal. Each L/S converts the voltage to a predetermined level based on the output signal from its corresponding data output terminal and inverted data output terminal of FF. The buffers drive the scan lines with the voltage level converted by the L/S.

The shift register 140 shifts the frame pulse sequentially according to a latch pulse LP that specifies the horizontal scan period. In this way, each scan line is selected in, for example, one vertical scan cycle. A selecting voltage is applied to the scan lines that are selected, while a non-selecting voltage is applied to the scan lines that are not selected.

The FF composing the shift register 140 is initialized by the scan control signal. Therefore, after the ending of the frame period including the second frame, in which the scan control signal is at the "L" level, scanning can be stopped and a predetermined non-selecting voltage can be applied to all of the scan lines as shown in FIG. 4.

1.2 Data Driver

Figure 6:
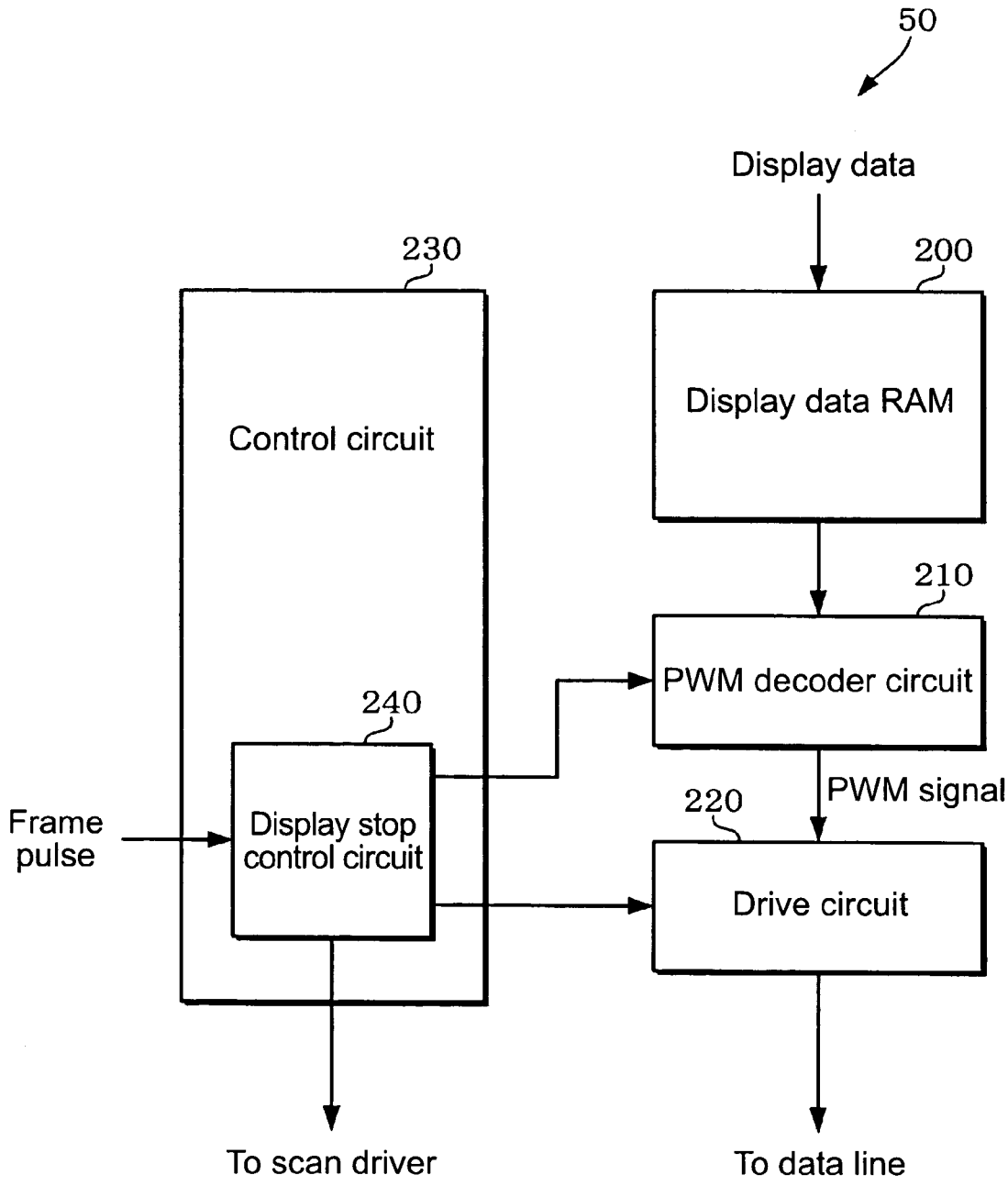
FIG. 6 shows a block diagram illustrating a schematic configuration of a data driver.

FIG. 6 shows a schematic configuration of the data driver 50. The data driver 50 includes a display data RAM 200, a pulse width modulation (PWM) decoder circuit 210, a drive circuit 220, and a control circuit 230 that control the above-described circuits.

The display data RAM 200 memorizes one frame worth of display data. Display data are written into the display data RAM 200 by an external host. The data driver 50 drives the data lines based on the display data that are memorized in the display data RAM 200.

The display data that are read from the display data RAM 200 are supplied to the PWM decoder circuit 210, which generates a PWM signal with a pulse width corresponding to the display data. The drive circuit 220 drives the data lines based on the PWM signal generated by the PWM decoder circuit 210.

In accordance with a display timing specified, for example, by the host, the control circuit 230 conducts the control of reading of the display data from the display data RAM 200 and specifies the scan timing to the scan driver 40.

The control circuit 230 includes a display stop control circuit 240. The display stop control circuit 240 has the same function as the display stop control circuit 52 shown in FIG. 3. The control circuit 230 can stop the operation of the display data RAM 200 or the PWM decoder circuit 210 by the display control signal shown in FIG. 3, for example. The drive circuit 220 stops the drive using the drive voltage corresponding to the display data by the display control signal shown in FIG. 3, for example. The drive circuit 220 can conduct the driving using drive voltage corresponding to gray scale value of 0 by the OFF data output control signal shown in FIG. 3.

The major constituents of an example configuration of the control circuit 230, which includes the display stop control circuit 240 to be applied to the data driver 50, will be described hereinafter.

The control circuit 230 conducts drive control of the data driver 50 by transiting among a plurality of states that include a sleep state, a display OFF state and a display ON state. The data driver further includes a power circuit for generating drive power. The drive power is generated, or such generation is stopped, depending on a transition target state that is to be transited to. Thus, as for the data driver 50, the drive control is conducted based on control signals that are associated with transition target states.

Figure 7:
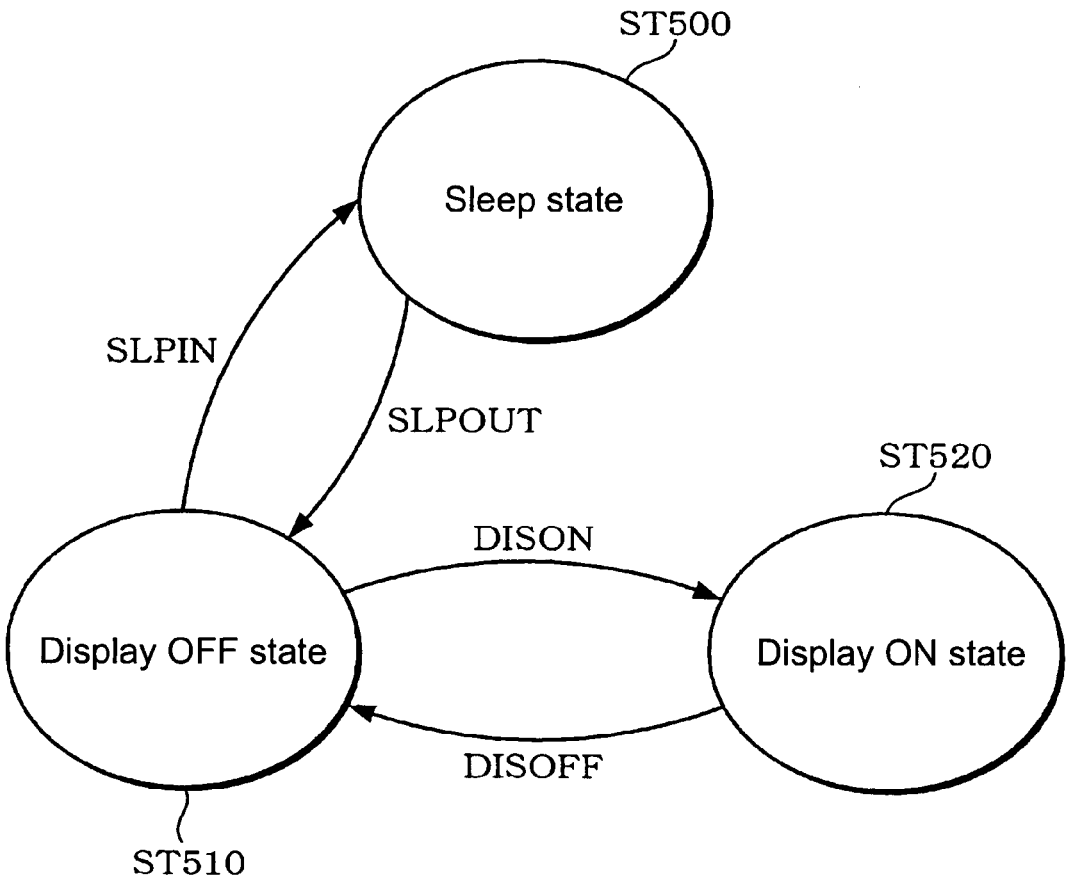
FIG. 7 shows a diagram illustrating an example of state transitions of a control circuit of a data driver.

FIG. 7 shows an example of state transitions controlled by the control circuit 230. For simplicity of description, an example, where drive control of the data driver is conducted using transition among three states: the sleep state, the display OFF state and the display ON state, is shown.

In the sleep state ST500, the data driver 50 does not generate drive power and hence does not conduct any display operations using drive signals. In the display ON state ST510, the data driver 50 generates drive power and conducts display operations using drive signals. In the display OFF state ST520, the data driver 50 generates drive power but does not conduct display operations using drive signals.

Figure 8:
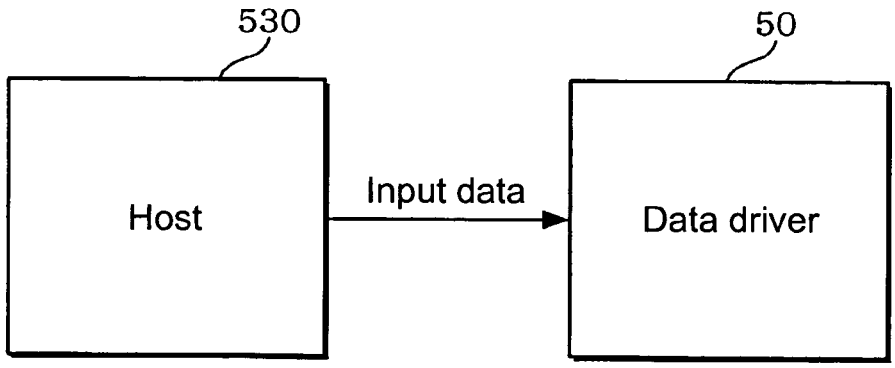
FIG. 8 shows a diagram of a data driver and a host.

As shown in FIG. 8, the data driver 50 can transit to any of the sleep state ST500, the display ON state ST510, or the display OFF state ST520 by commands that are input by a host 530 such as an MPU.

More specifically, when in the sleep state ST500, the data driver 50 transits to the display OFF state ST510 in response to a SLPOUT command input by the host 530. Similarly when in the display OFF state ST510, the data driver 50 transits to the sleep state ST500 in response to a SLPIN command (sleep signal for putting the driver into the sleep state, in which drive of the data lines is stopped) similarly being input by the host 530, or to the display ON state ST520 in response to a DISON command similarly being input by the host 530. When in the display ON state ST520, the data driver 50 transits to the display OFF state ST510 in response to a DISOFF command input by the host 530.

Figure 9A:
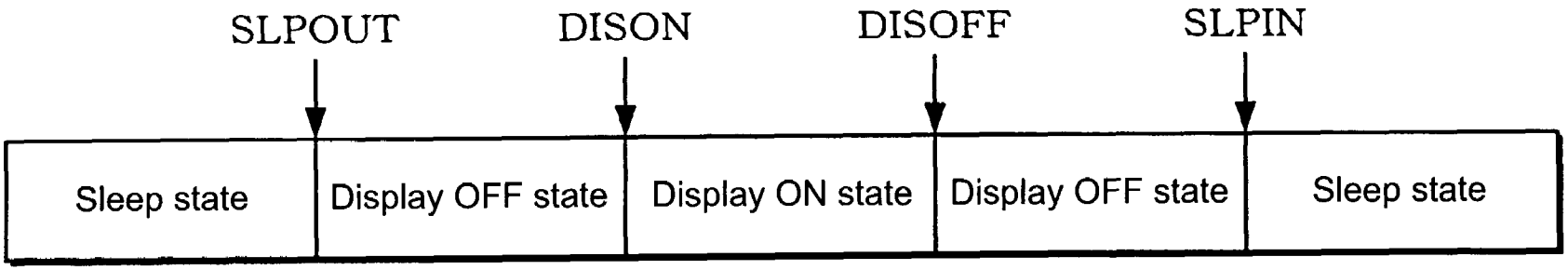
FIGS. 9 (A) and (B) show schematic diagrams illustrating state transitions in response to commands that are input in each state.

FIGS. 9(A) and (B) show schematic transitions in response to commands input in various states. FIG. 9(A) shows schematically the state transitions when commands are input in various states shown in FIG. 8. FIG. 9 (B) shows schematically the state transitions that can be realized by altering the input order of the commands to each state shown in FIG. 8.

In FIG. 9(A), as shown in FIG. 8, the state transits to the display OFF state by a SLPOUT command input to the sleep state, for example. The state transits to the display ON state by a DISON command input to the display OFF state, for example.

Figure 9B:
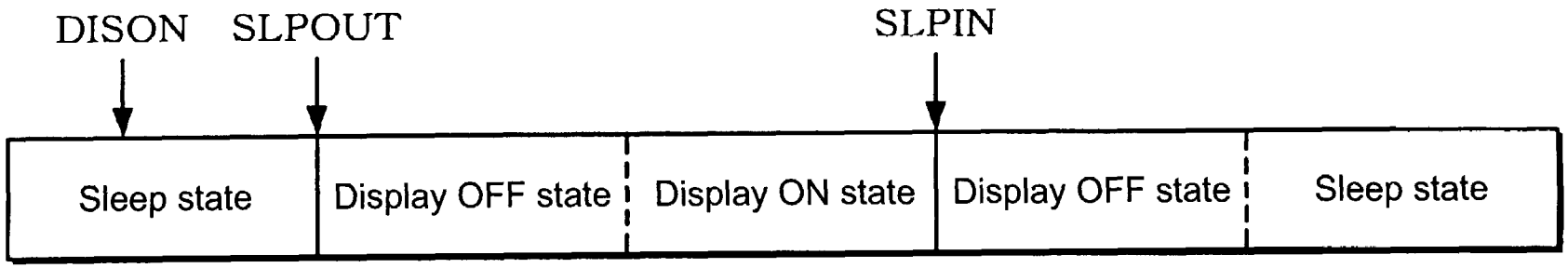

In FIG. 9(B), on the other hand, when a DISON command is input to the sleep state, the state does not transit to any states in the state transition diagram shown in FIG. 8. However, when the SLPOUT command is input to the sleep state on a condition that a DISON command has already been input to the sleep state, the state transits to the display OFF state, and followed by an automatic transition to the display ON state without a fresh DISON command being input. In this way, bothersome command input can be avoided.

Similarly, when a SLPIN command is input to the display ON state, the state transits to the display OFF state, and followed by an automatic transition to the sleep state without a fresh SLPIN command being input.

Figure 10:
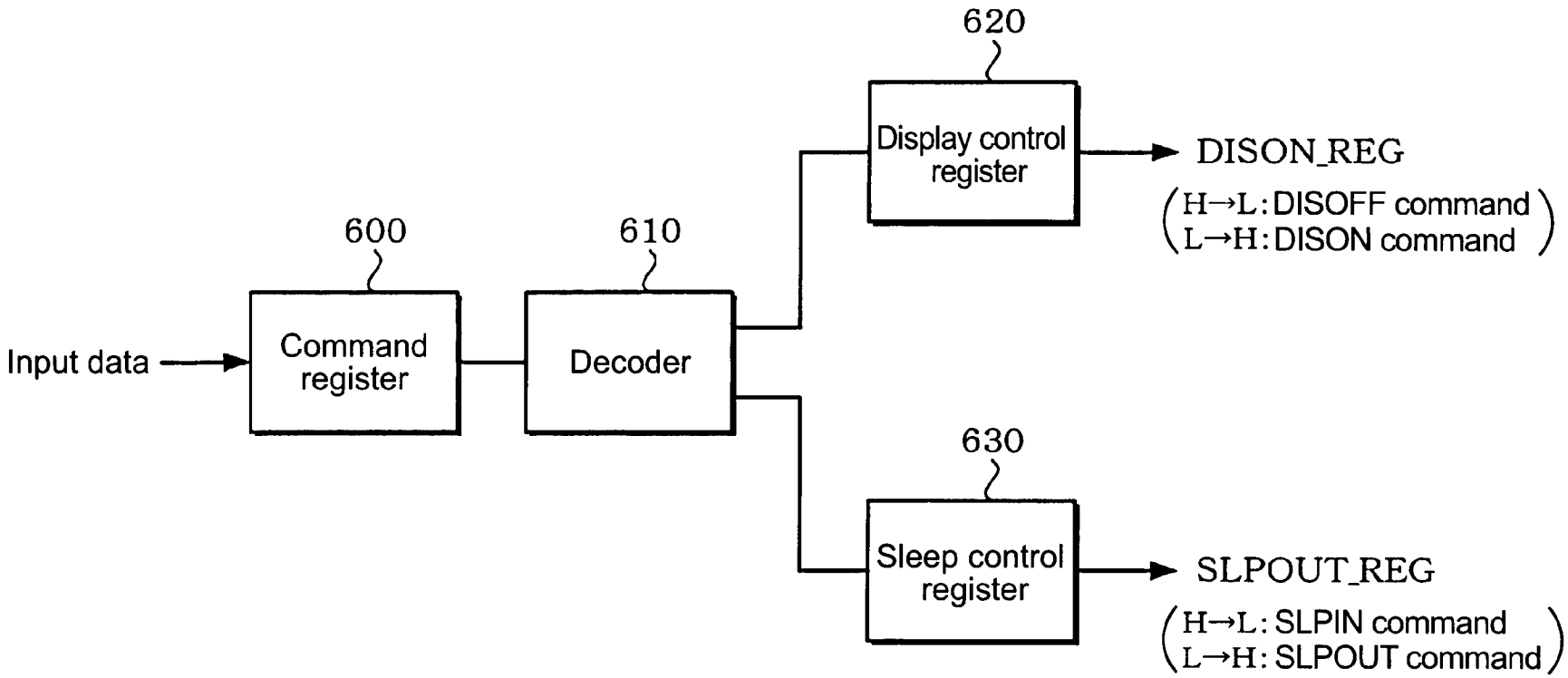
FIG. 10 shows a block diagram illustrating a schematic configuration of a command input unit included in a control circuit.

FIG. 10 shows a schematic view of the configuration of the command input unit included in the control circuit 230. The command input unit of the control circuit 230 includes a command register 600, a decoder 610, a display control register 620 and a sleep control register 630.

The command register 600 registers commands from the host 530 as input data. The decoder 610 decodes the input data registered in the command register 600.

When the input data registered in the command register 600 are determined to be a DISON command or a DISOFF command by the decoder 610, data corresponding to such commands are registered in the display control register 620. In case of the DISON command, "1" is registered in the display control register 620, while in case of the DISOFF command, "0" is registered in the display control register 620. The input of the display control register 620 is output as DISON_REG signal. Accordingly, when the DISON_REG signal changes from the "H" level to the "L" level, it signifies that the DISOFF command has been registered. Conversely, when the DISON_REG signal changes from the "L" level to the "H" level, it signifies that the DISON command has been registered.

When the input data registered in the command register 600 is determined to be a SLPOUT command or a SLPIN command by the decoder 610, data corresponding to such command are registered in the sleep control register 630. In case of the SLPOUT command, "1" is registered in the sleep control register 630, while in case of the SLPIN command, "0" is registered in the sleep control register 630. The input of the sleep control register 630 is output as SLPOUT_REG signal. Accordingly, when the SLPOUT_REG signal. changes from the "H" level to the "L" level, it signifies that the SLPIN command has been registered. Conversely, when the SLPOUT_REG signal changes from the "L" level to the "H" level, it signifies that the SLPOUT command has been registered.

Figure 11:
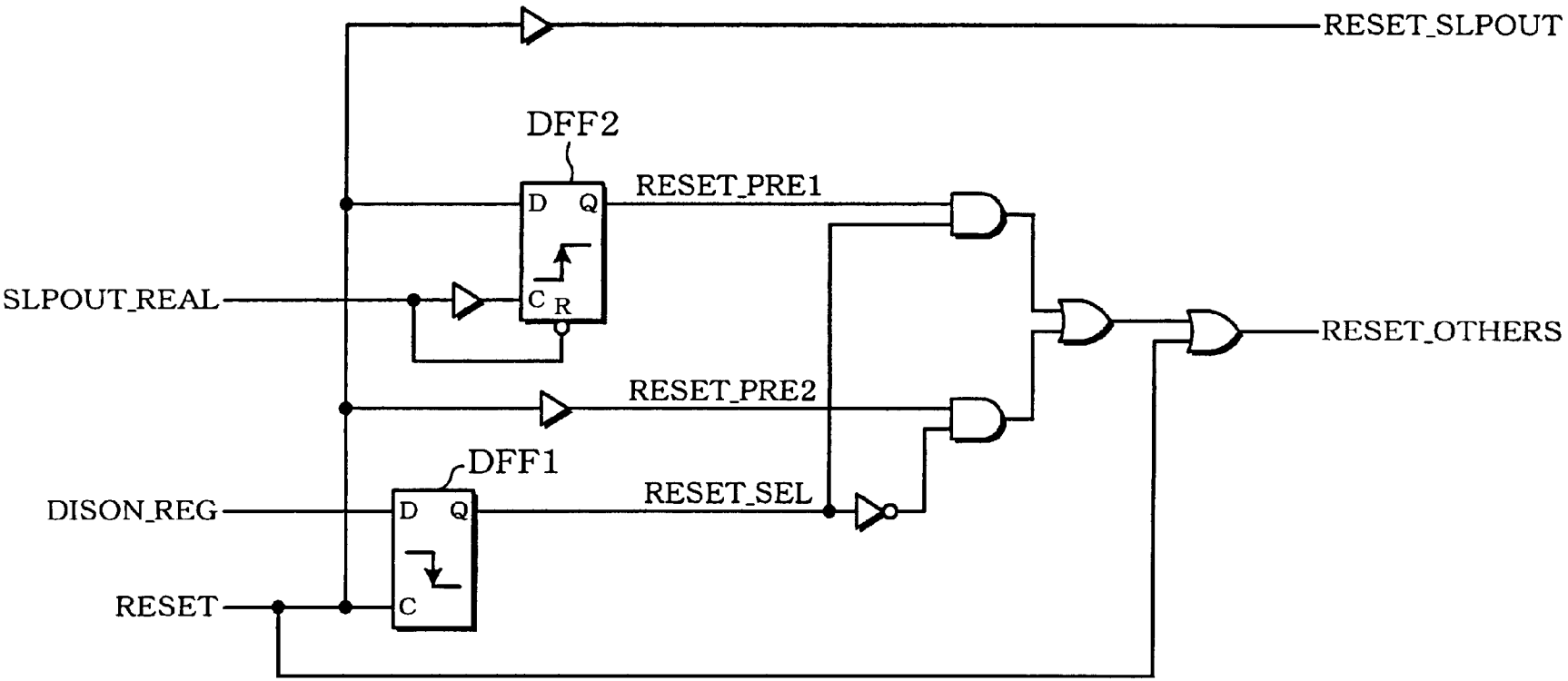
FIG. 11 shows a circuit diagram illustrating an example configuration of major constituents of a display stop control circuit in FIG. 6.
Figure 12:
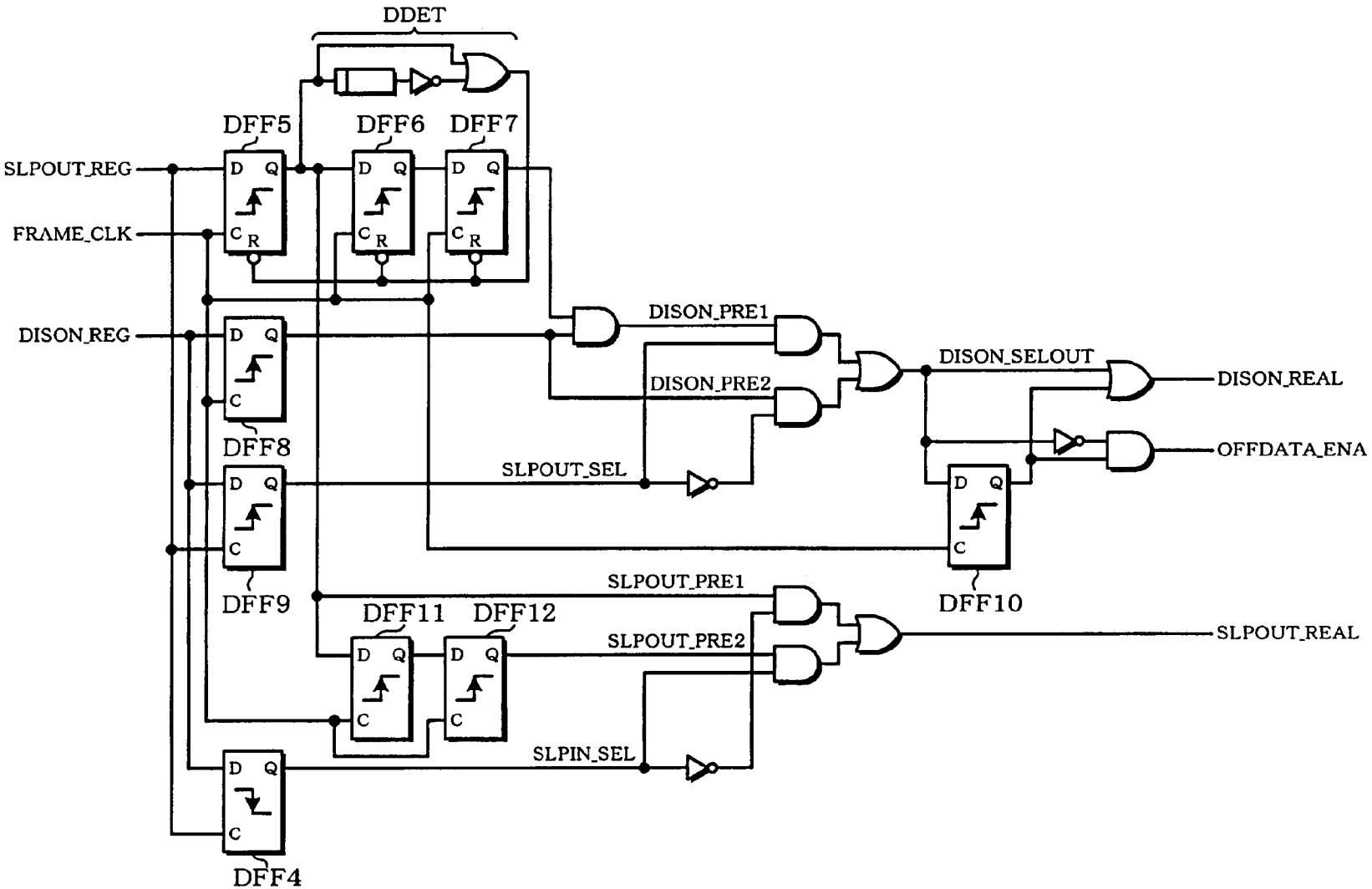
FIG. 12 shows a circuit diagram illustrating another example configuration of major constituents of a display stop control circuit in FIG. 6.

FIGS. 11 and 12 show the major constituents of example configurations of the display stop control circuit 240. In FIG. 11, the RESET signal is an initializing signal used as the display stopping signal, and is active at the "L" level. A SLPOUT_REAL signal is generated by a circuit shown in FIG. 12. The DISON_REG signal is a signal corresponding to the input of the display control register 620 shown in FIG. 10.

DFF1 takes in the DISON_REG signal when the RESET signal falls, and outputs a RESET_SEL signal.

DFF2 takes in the RESET signal when the SLPOUT_REAL signal, which is input via a buffer, rises, and outputs a RESET_PRE1 signal. DFF2 is reset when the SLPOUT_REAL signal is at the "L" level.

A RESET_PRE2 signal is the output signal of a buffer, to which the RESET signal is input. A RESET_OTHERS signal is the logical sum of one of the RESET_PRE1 and the RESET_PRE2 signal selected based on the RESET_SEL signal, and the RESET signal. A RESET_SLPOUT signal is the output signal of a buffer, to which the RESET signal is input.

When the RESET_SLPOUT signal is at the "L" level, only the sleep control register 630 is initialized. The RESET_OTHERS signal initializes the display control register 620 and control registers (not shown), excluding the sleep control register 630.

In FIG. 12, a FRAME_CLK signal corresponds to the frame pulse. The SLPOUT_REG signal is a signal corresponding to the input of the sleep control register 630 shown in FIG. 10.

DFF4 takes in the DISON_REG signal when the SLPOUT_REG signal falls, and outputs it as a SLPIN_SEL signal. Falling of the SLPOUT_REG signal signifies that the SLPIN command has been input. Therefore, DFF4 outputs the DISON_REG signal as the SLPIN_SEL signal when the SLPIN command is input.

DFF5, takes in the SLPOUT_REG signal when the FRAME_CLK signal rises, and outputs it as an SLPOUT_PRE1 signal. DFF6 takes in the SLPOUT_PRE1 signal when the FRAME_CLK signal rises. DFF7 takes in the output signal of DFF6 when the FRAME_CLK signal rises. A falling edge detection circuit DDET detects the falling edge of the SLPOUT_PRE1 signal, and output the result as a pulse. When the pulse is at the "L" level, DFF5 and DFF6 are initialized.

DFF8 takes in the DISON_REG signal when the FRAME_CLK signal rises, and outputs it as a DISON_PRE2 signal. The logical product of the output signal of DFF7 and the DISON_PRE2 signal becomes the DISON_PRE1 signal. DFF9 takes in the DISON_REG signal when the SLPOUT_REG signal rises, and outputs it as a SLPOUT_SEL signal.

The DISON_PRE1 signal changes to the "H" level, if a DISON command is input when three frames have elapsed from the frame where the SLPOUT command was input. The DISON_PRE2 signal changes to the "H" level in the next frame after the one where the DISON command was input. The SLPOUT_SEL signal indicates whether or not a DISON command has been input when the SLPOUT command is input. In FIG. 12, the DISON_PRE1 signal is selected and output as the DISON_SELOUT signal, if a DISON command has been input when the SLPOUT command is input, while the DISON_PRE2 signal is selected and output as the DISON_SELOUT signal, if a DISON command has not been input when the SLPOUT command is input.

DFF10 takes in the DISON_SELOUT signal when the FRAME_CLK signal rises. The logical sum of the output signal of DFF10 and the DISON_SELOUT signal becomes the DISON_REAL signal. The logical product of the output signal of DFF10 and the inverted signal of the DISON_SELOUT signal becomes an OFFDATA_ENA signal.

In other words, the DISON_REAL signal is a signal, in which the DISON_SELOUT signal is extended by just one frame. The OFFDATA_ENA signal is a signal that changes to the "H" level just for the one frame that comes after falling of the DISON_SELOUT signal.

The DISON_SELOUT signal corresponds to the display control signal in FIGS. 3 and 4. The DISON_REAL signal corresponds to the scan control signal in FIGS. 3 and 4. The OFFDATA_ENA signal corresponds to the OFF data output control signal in FIGS. 3 and 4.

Therefore, because the SLPOUT_REG signal changes from the "H" level to the "L" level when the RESET signal is input as display stopping signal, in FIG. 12, DFF5 corresponds to the first frame synchronization circuit 100 in FIG. 3, for example. Likewise in FIG. 12, DFF6 through DFF9 and the other logic circuit for generating the DISON_REAL signal correspond to the second frame synchronization circuit 110 in FIG. 3. Further, in FIG. 12, DFF10 and the other logic circuits for generating the OFFDATA_ENA signal correspond to the OFF data output control circuit 120 in FIG. 3.

DFF11 takes in the SLPOUT_PRE1 signal when the FRAME_CLK signal rises. DFF12 takes in the output signal of DFF11 when the FRAME_CLK signal rises, and outputs it as the SLPOUT_PRE2 signal.

The SLPOUT_REAL signal is a signal, which is selectively output either the SLPOUT_PRE1 signal or the SLPOUT_PRE2 signal according to the SLPIN_SEL signal.

Figure 13:
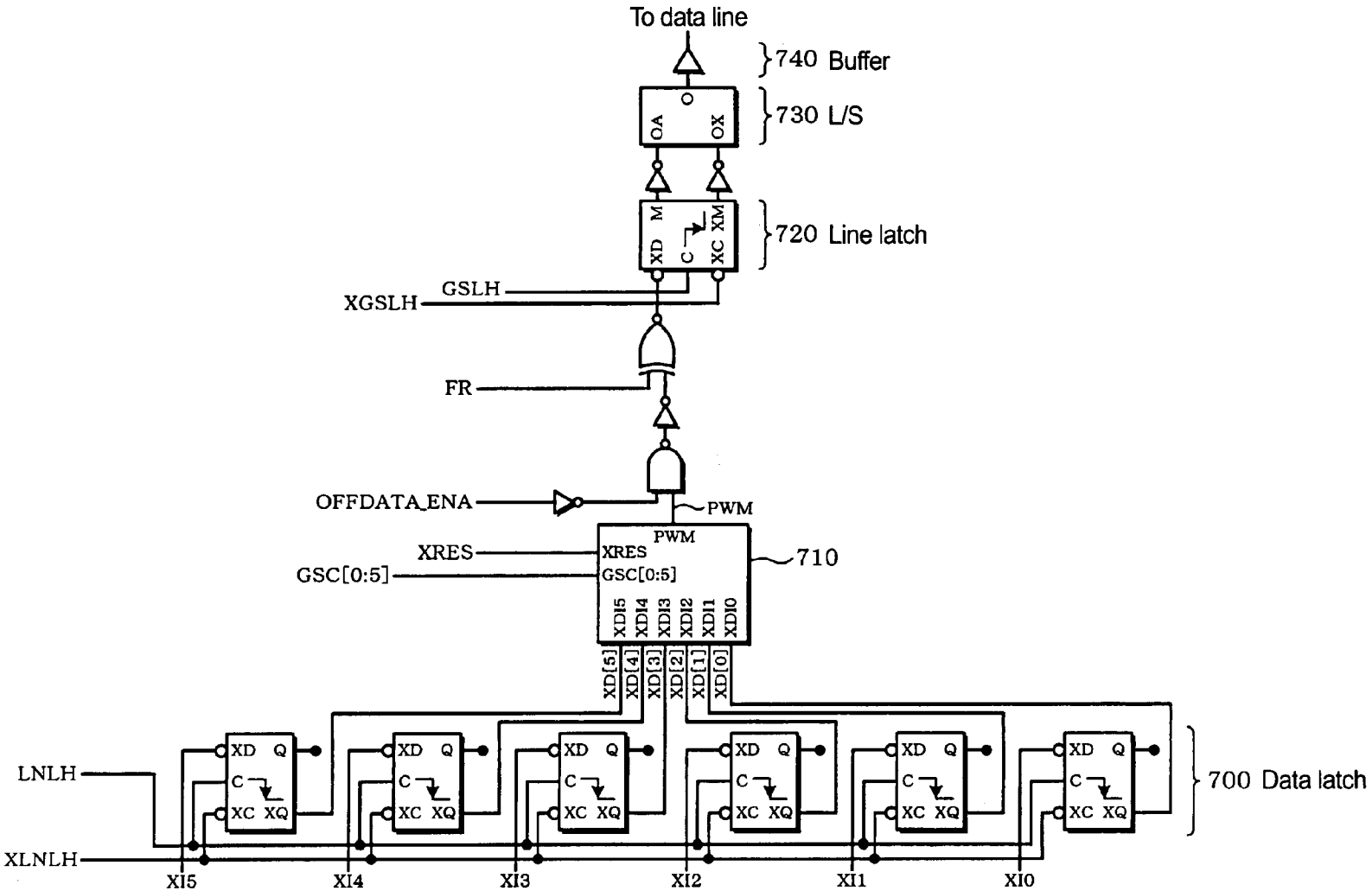
FIG. 13 shows a circuit diagram illustrating an example configuration of a PWM decoder circuit and a drive circuit in FIG. 6.

FIG. 13 shows an example configuration of the PWM decoder circuit 210 and the drive circuit 220 shown in FIG. 6. Only the configuration of the output of one data line is shown here, but the outputs of the other data lines have a similar configuration. In FIG. 13, inverted display data X15 through X10, which are the results of inversion of display data configuring six bits for one dot, are taken into a data latch 700 from the display data RAM 200. When a display data is "101010 (=2 Ah)", the inverted display data X15 through X10 become "010101 (=15 h)". The data latch 700 takes in the inverted display data X15 through X10 when the latch enable LNLH rises (when inverse signal XLNLH of latch enable LNLH falls). The latch enable LNLH has a change point, in which it changes at an earlier timing than the change point of latch pulse LP. The display data taken into the data latch 700 based on the latch enable LNLH (inverse signal XLNLH of latch enable LNLH) is supplied to the PWM decoder circuit 710.

The PWM decoder circuit 710 is a coincidence detection circuit. A gray scale reset signal XRES and a six-bit gray scale count GSC [5:0] are supplied to the PWM decoder circuit 710. The gray scale reset signal XRES changes to the "L" level each time that a horizontal scan cycle starts. The gray scale count GSC [5:0] is initialized by the gray scale reset signal XRES. The gray scale count GSC [5:0] is incremented by a gray scale clock during each horizontal scan period.

Figure 14:
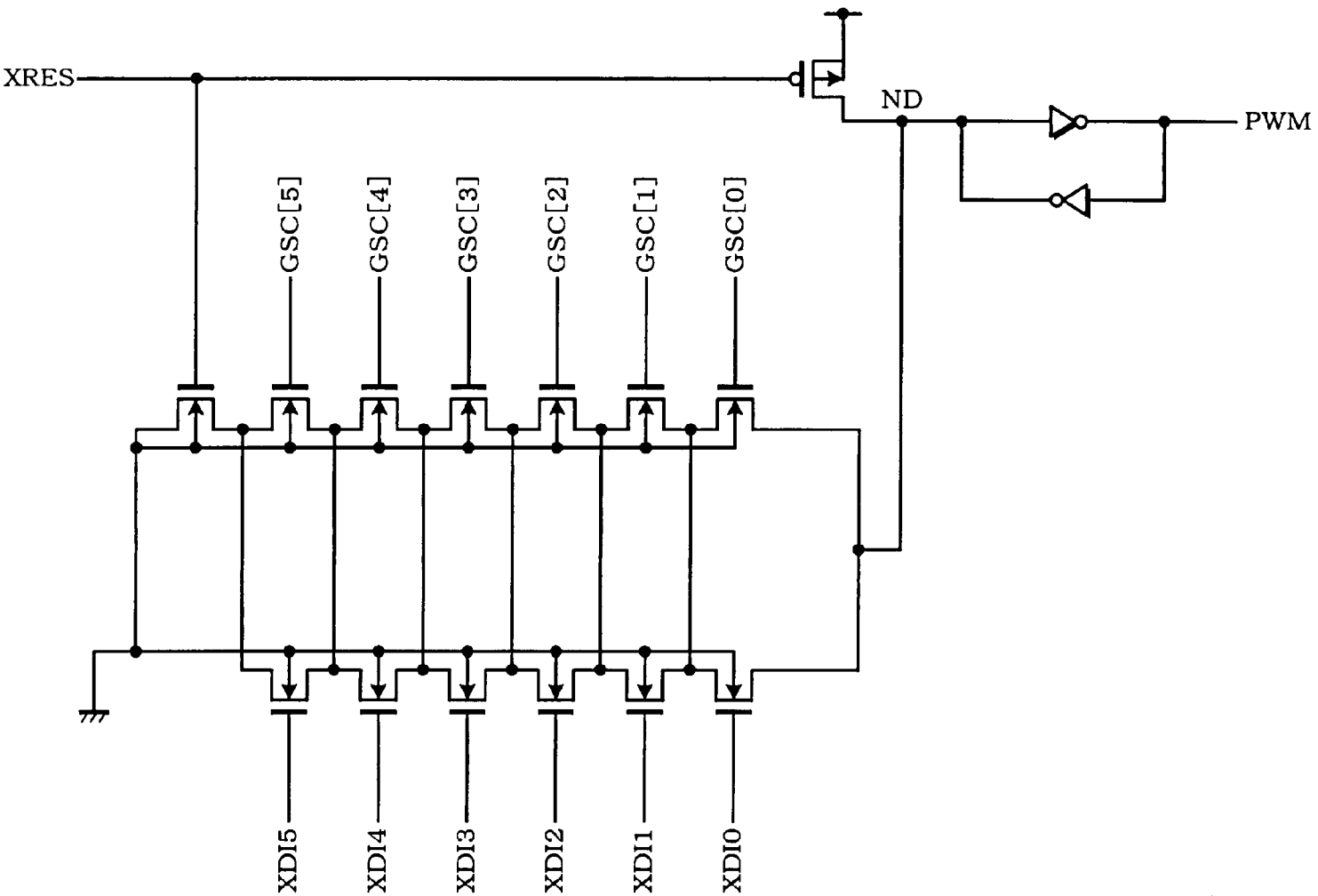
FIG. 14 shows a circuit diagram, illustrating an example configuration of a PWM decoder circuit.

FIG. 14 shows an example configuration of the PWM decoder circuit 710. The PWM decoder circuit 710 detects coincidence of the inverted display data X15 through X10 with the gray scale counter GSC [5:0]. "Coincidence detection" refers to detecting that the bits of the inverted display data X15 through X10 and the bits of the gray scale counter GSC [5:0] are mutually complementary. However, such detection may be alternatively conducted by detecting states that are equivalent to coincidence between two values with the bit-level detection whether the two values to be compared are equal or not.

When the bits of the inverted display data X15 through X10 and the bits of the gray scale counter GSC [5:0] are mutually complementary, a node ND that has been pre-charged by the gray scale reset signal XRES changes to the "L" level. Because the logical level of the node ND is retained by a flip-flop, the PWM signal changes from the "L" level to the "H" level when the bits of the inverted display data X15 through X10 and the bits of the gray scale counter GSC [5:0] are mutually complementary. As a result, the PWM signal can possess a pulse width corresponding to the gray scale value used as the display data.

Figure 15:
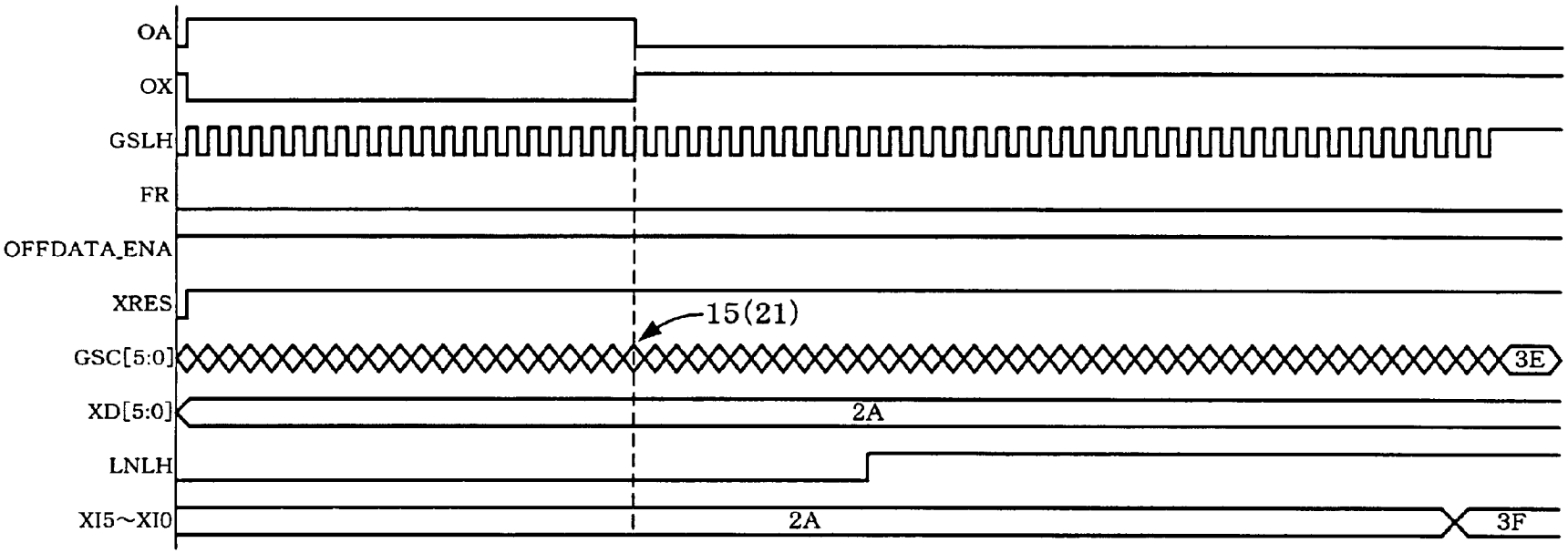
FIG. 15 shows a timing diagram of an example operation of the circuits shown in FIGS. 13 and 14.

FIG. 15 shows an example of the operation of the circuits shown in FIGS. 13 and 14. The example assumes that the inverted display data X15 through X10 are "101010 (=2 Ah)". When the grayscale reset signal XRES changes to the "L" level, the gray scale count GSC [5:0] is incremented, starting from its initialized state, and when it reaches "010101 (=15 h)", the bits of the gray scale count GSC [5:0] becomes mutually complementary with the bits of the inverted display data X15 through X10. Therefore, when the gray scale count GSC [5:0] is "010101 (=15 h)", the PWM signal changes to the "H" level.

In FIG. 13, the PWM signal, which is output from the PWM decoder circuit 710, is masked by an inverted signal of the OFFDATA_ENA signal. Therefore, the pulse width of the masked signal can be a pulse width corresponding to the gray scale value of 0 by the OFFDATA_ENA signal. By using the OFFDATA_ENA signal for masking in this way, a drive voltage corresponding to the OFF data can be output by a simple configuration, without having the PWM decoder circuit 710 generate a pulse width corresponding to the gray scale value of 0.

The masked signal undergoes, for example, frame inversion based on a polarity reversal signal FR. The frame-inverted signal is taken into the line latch 720. The line latch 720 takes in the frame-inverted signal based on a gray scale latch enable signal GSLH and the inverted signal XGSLH. The level of the signal taken into the line latch 720 is converted by an L/S 730. The output of L/S 730 is input to a buffer 740. The output of the buffer 740 is coupled to the data lines.

The operation of the circuits shown in FIGS. 11 and 12 will be described hereinafter.

Figure 16:
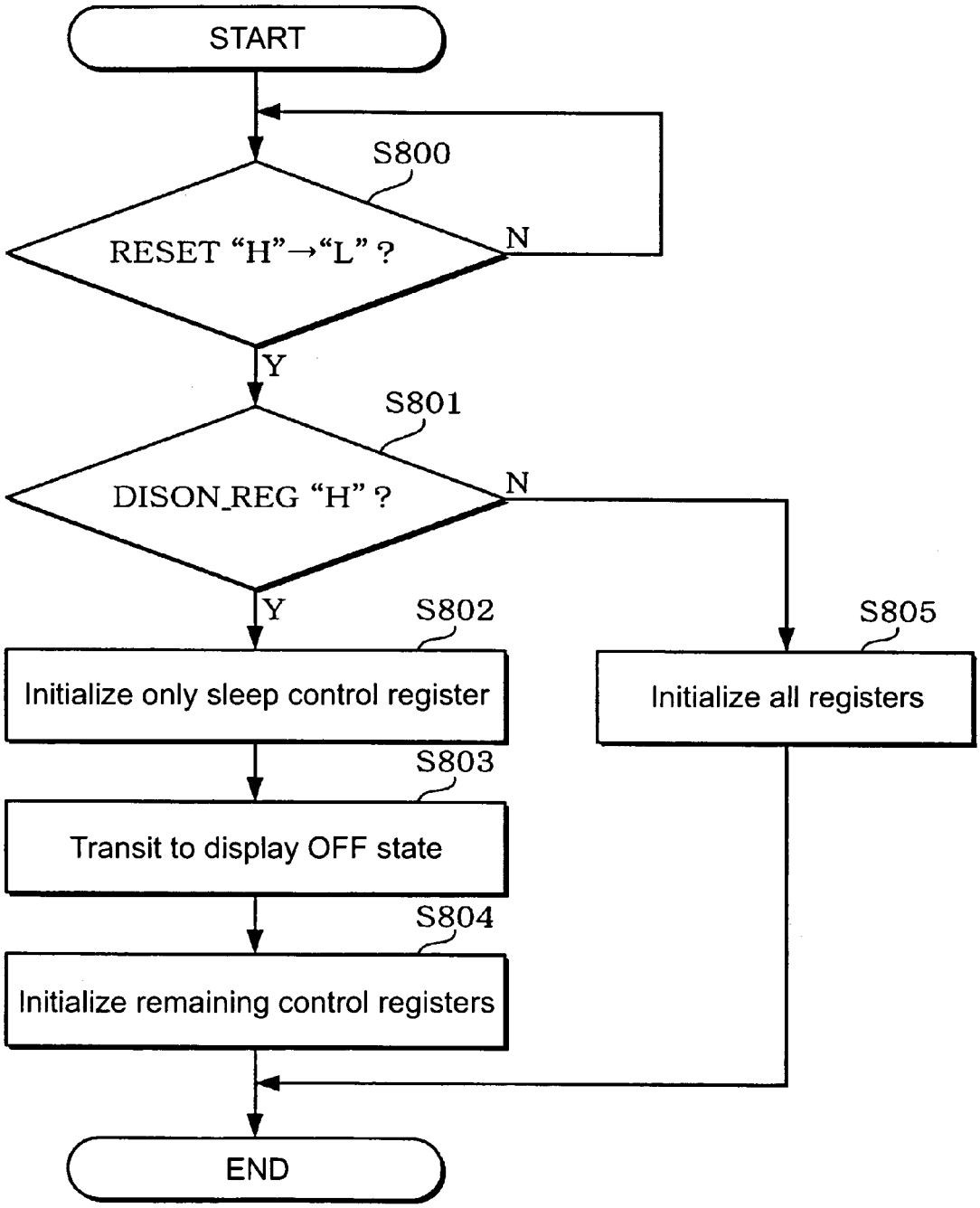
FIG. 16 shows a flow diagram illustrating an outline of operation of a circuit shown in FIG. 11.

FIG. 16 shows an outline of operational flow of the circuit shown in FIG. 11.

Figure 17:
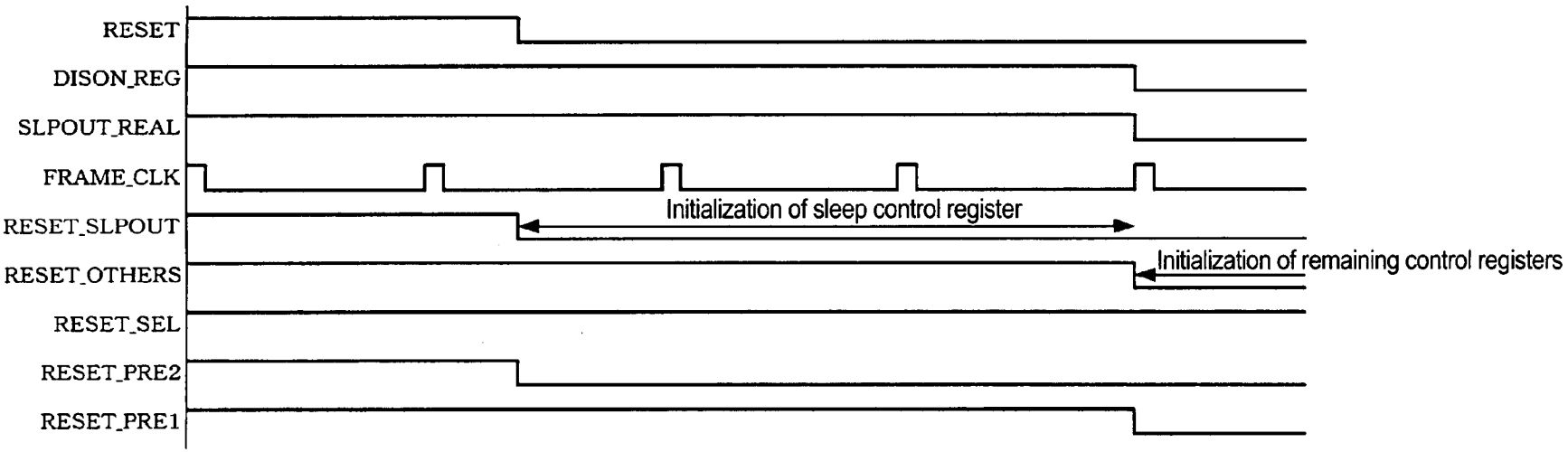
FIG. 17 shows a timing diagram of an example operation of a circuit shown in FIG. 11.

FIG. 17 shows a timing diagram for an example operation of the circuit shown in FIG. 11. In the circuit shown in FIG. 11, when the RESET signal changes from the "H" level to the "L" level (step S800:Y), DFF1 takes in the DISON_REG signal, and outputs the RESET_SEL signal. When the DISON_REG signal is at the "H" level (step S801:Y), the RESET_PRE1 signal is selected as the RESET_OTHERS signal. As a result, only the RESET_SLPOUT signal changes to the "L" level and only the sleep control register 630 is initialized (step S802). When the sleep control register 630 is initialized, the SLPOUT_REG signal changes from the "H" level to the "L" level, so that the states transits to the display OFF state (step S803). As described later, this makes the SLPOUT_REAL signal in the circuit shown in FIG. 12 change to the "L" level. Therefore, the RESET_PRE1 signal changes to the "L" level, and is output as the RESET_OTHERS signal. As a result, the remaining control registers are initialized (step S804).

On the other hand, when the RESET signal has changed from the "H" to the "L" level, and the DISON_REG signal is at the "L" level in step S801 (Step S801:N), the RESET_PRE2 signal is selected and output as the RESET_OTHERS signal (Step S805). As a result, all of the control registers including the sleep control register 630 are initialized.

Figure 18:
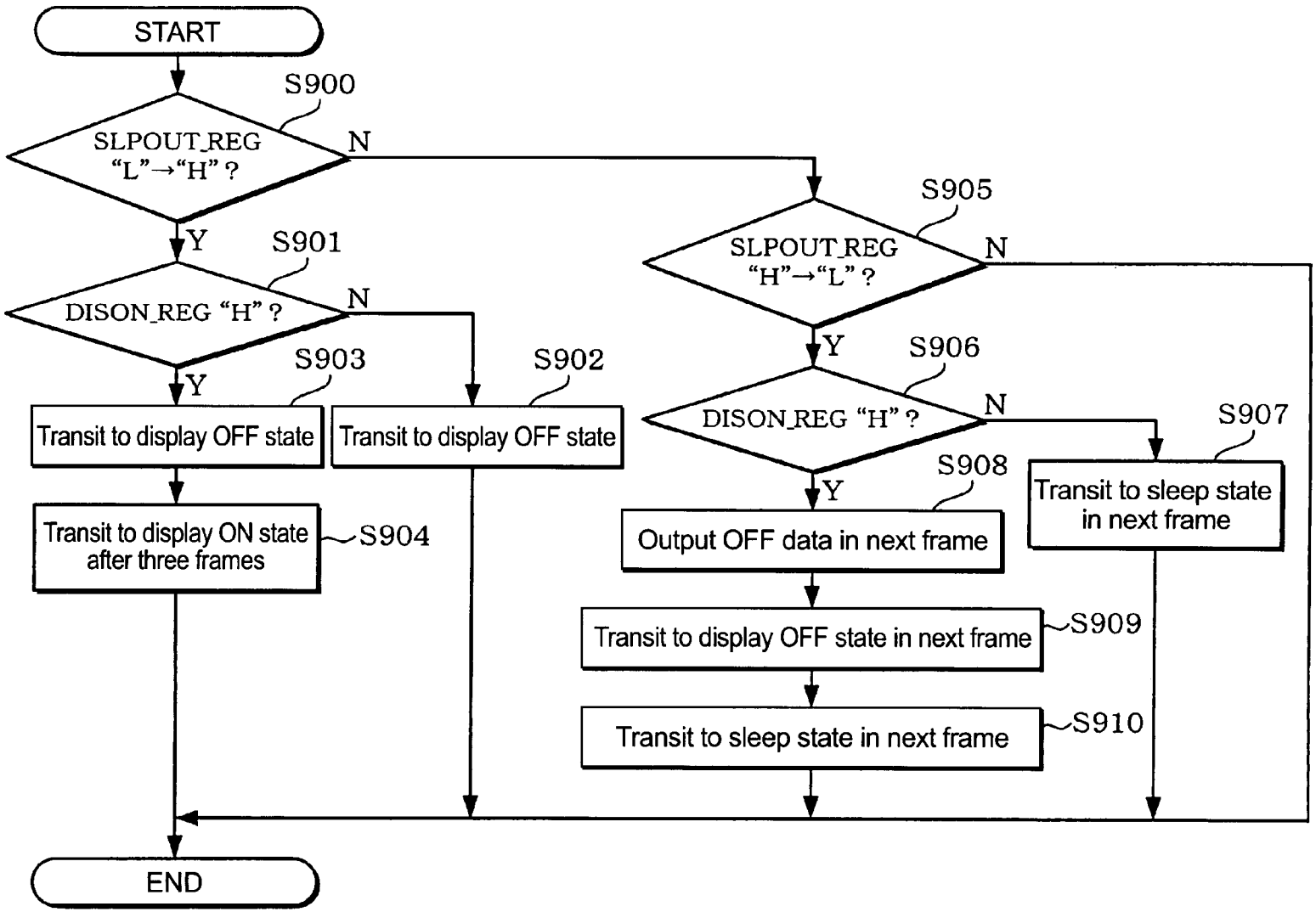
FIG. 18 shows a flow diagram illustrating an outline of operation of the circuit shown in FIG. 12.

FIG. 18 shows an outline of operational flow of the circuit shown in FIG. 12.

Figure 19:
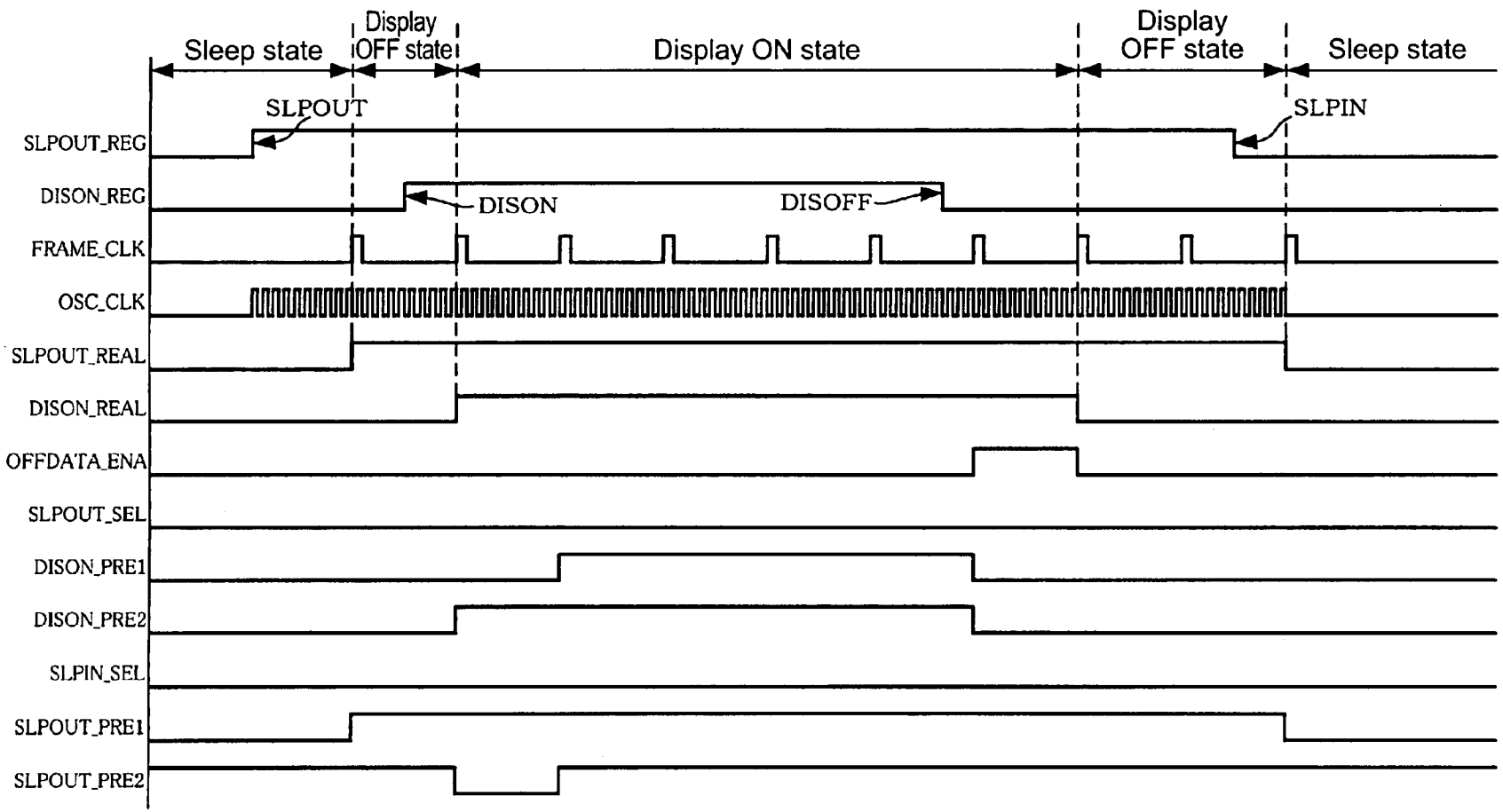
FIG. 19 shows a timing diagram of a first example operation of a circuit shown in FIG. 12.

FIG. 19 shows a timing diagram for a first example operation of the circuit shown in FIG. 12. As shown in FIG. 9(A), the first example operation represents the operation where a DISON command is input after an SLPOUT command is input to the sleep state, and transited to the display OFF state.

Figure 20:
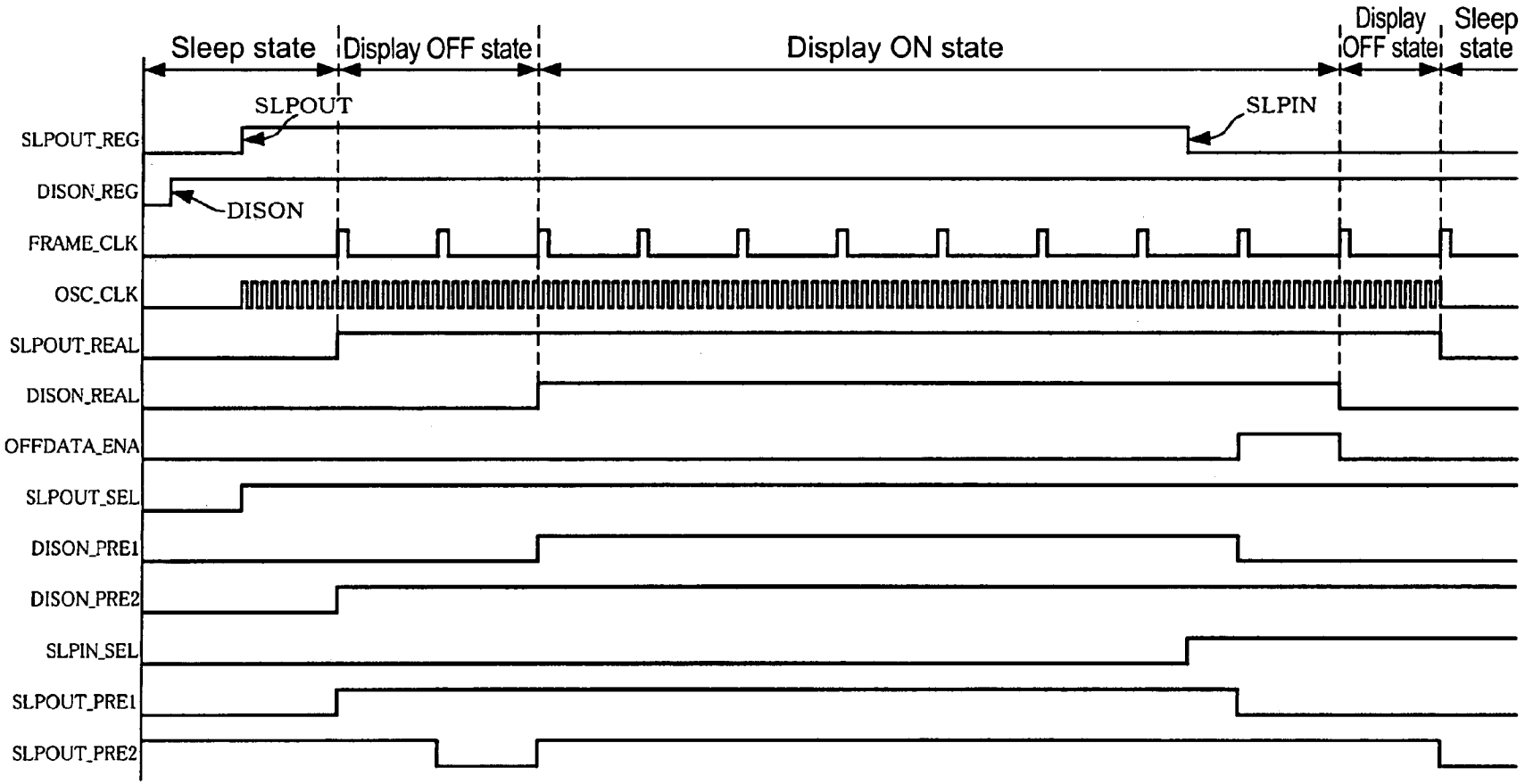
FIG. 20 shows a timing diagram of a second example operation of a circuit shown in FIG. 12.

FIG. 20 shows a timing diagram for a second example operation of the circuit shown in FIG. 12. As shown in FIG. 9(B), the second example operation represents the operation where an SLPOUT command is input after a DISON command has been input to the sleep state.

When an SLPOUT command is input to the sleep state, the SLPOUT_REG signal changes from the "L" level to the "H" level. At this time (step S900:Y), the DISON_REG signal is taken in by DFF9 shown in FIG. 12. When the DISON_REG signal is at, the "L" level (step S901:N), the DISON_PRE2 signal is output as the DISON_SELOUT signal.

This makes the DISON_REAL signal change to the "L" level, triggering transition to the display OFF state (step S902). The DISON_REAL signal conducts, for example, output control of drive control signals such as the enable signal for drive of the data lines. With such output control, varying or fixing of the drive control signals is conducted. When the DISON_REAL signal is at the "H" level, output control of the drive control signals is turned on and the drive control signals are varied, while when it is at the "L" level, output control of the drive control signals is turned off and the drive control signals are fixed.

When the DISON_REG signal is at the "H" level at step S901 (step S901:Y), the DISON_PRE1 signal is output as the DISON_SELOUT signal. The DISON_PRE1 signal changes to the "H" level when the SLPOUT_REG signal has been at the "H" level for a period of three frames. Therefore, during such period, the circuit transits to the display OFF state (step S903), as shown in FIG. 20. Then, three frames after the flame that is input the SLPOUT command, the circuit transits to the display ON state (step S904).

When the SLPIN command is input to the display OFF state or display ON state, the SLPOUT_REG signal changes from the "H" level to the "L" level. When this happens (step S900:N, step S905:Y), the DISON_REG signal is taken in by the DFF4 shown in FIG. 12. When the DISON_REG signal is at the "L" level (step S906:N), the SLPOUT_PRE1 signal is output as the SLPOUT_REAI signal. As a result, the circuit transits to the sleep state in the next frame after the one where the SLPIN command is input (step S907) as shown in FIG. 19.

At step S906, when the SLPOUT_REG signal has changed from the "H" level to the "L" level, and when the DISON_REG signal taken in by DFF4 is at the "H" level (step S906:N), the SLPOUT_PRE2 signal is output as the SLPOUT_REAL signal. When the SLPOUT_REG signal remains at the "H" level for a period of three frames, the SLPOUT_PRE2 signal changes to "H" level, so that the circuit does not transit to the sleep state during such period. When an SLPIN command is input at such period, as shown in FIG. 20, the SLPOUT_REG signal changes to the "L" level, so that the falling edge detection circuit DDET detects a fall of the output of DFF5. Therefore, in the next frame after the one where the SLPIN command was input, DFF5 and DFF6 are initialized and the DISON_PRE1 signal changes to the "L" level. As a result, in the frame where the DISON_ PRE1 signal changes to the "L" level, the OFFDATA_ENA signal changes to the "H" level and drive voltage corresponding to the OFF data is output to the data lines (step S908).

In the succeeding frame, the DISON_REAL signal changes to the "L" level, so that the circuit transits to the display OFF state (step S909).

Subsequently, when two frames have passed after DFF5 is initialized at the time when the falling edge detection circuit DDET detected its falling edge, the SLPOUT_PRE2 signal changes to the "L" level, so that the circuit transits to the sleep state (step S910).

When the SLPOUT_REAL signal is at the "H" level, the operation of the power circuit can be turned on so as to have drive power generated. Conversely, when the SLPOUT_REAL signal is at the "L" level, the operation of the power circuit can be turned off so as to stop generation of drive power. Moreover, when the SLPOUT_REAL signal is at the "H" level, the oscillation operation of the oscillating circuit, which generates the drive reference clock for specifying the above-described display timing and latch timing, can be turned on. Moreover, when the SLPOUT_REAL signal is at the "L" level, the oscillation operation of the oscillating circuits can be turned off.

The present invention is not limited to the above-described embodiment, and various modifications can be made within the scope of the spirit of the present invention.

Furthermore, as for the invention cited in the dependent claims in the present invention, some of the configurational components of the independent claim may be omitted from such a configuration. Moreover, major elements of the invention relating to the independent claims of the present invention may be made dependent on other independent claims.

What is claimed is:

1. A display system, comprising:

an active matrix type display panel;

a data driver that drives data lines of the display panel; and a scan driver that scans scan lines of the display panel, the data driver outputting a drive voltage corresponding to a predetermined gray scale value to the data lines during a second frame period that includes a second and subsequent frames, the second frame being the next frame after a first frame where a display stopping signal is input, then outputting a non-display voltage to the data lines after the frame period ends, the scan driver outputting a selecting voltage to the scan lines, and scanning the scan lines during a first frame period of the first frame and the second frame period, and outputting a non-selecting voltage to all of the scan lines after the second frame period ends, and the data driver and the scan driver being set to a sleep mode when a predetermined frame period elapsed after the second frame period ends if the display stopping signal is a sleep signal.

2. A display system, comprising:

an active matrix type display panel;

a data driver that drives data lines of the display panel;

a scan driver that scans scan lines of the display panel;

a first frame synchronization circuit that outputs a display control signal, which synchronizes a display stopping signal for stopping an image display of the display panel with a frame pulse that specifies a vertical scan period of the display panel;

a second frame synchronization circuit that outputs a scan control signal, which synchronizes the display control signal with the frame pulse; and an OFF data output control circuit that outputs an OFF data control signal for outputting a drive voltage corresponding to a predetermined gray scale value to the data lines based on the display control signal during a second frame period that includes a second and subsequent frames, the second frame being the next frame after a first frame where the display stopping signal is input, the data driver outputting the drive voltage to the data lines based on the OFF data output control signal during the frame period, then outputting a non-display voltage to the data lines after the second frame period ends, and the scan driver outputting a selecting voltage to the scan lines, and scanning the scan lines based on the scan control signal during a first frame period of the first frame and the second frame period, and outputting the non-selecting voltage to all of the scan lines after the second frame period ends, and the data driver and the scan driver being set to a sleep mode when a predetermined frame period elapsed after the second frame period ends if the display stopping signal is a sleep signal.

3. The display system according to claim 2, the display stopping signal being at least one of:

an initializing signal for the data driver; and the sleep signal that sets a sleep state;

in which drive for the data lines is stopped.

4. The display system according to claim 2, a drive voltage corresponding to the predetermined gray scale value being a drive voltage corresponding to a gray scale value of 0.

5. A data driver for driving data lines of an active matrix type display panel, comprising:

a first frame synchronization circuit that outputs a display control signal, and that synchronizes a display stopping signal for stopping an image display of the display panel with a frame pulse that specifies a vertical scan period of the display panel;

a second frame synchronization circuit that outputs scan control signals, and that synchronizes the display control signal with the frame pulses;

an OFF data output control circuit that outputs an OFF data output control signal for outputting a drive voltage corresponding to a predetermined gray scale value to the data lines based on the display control signal, the OFF data output control signal specifying a second frame period that includes a second and subsequent frames, the second frame being the next frame after a first frame where the display stopping signal is input; and a drive circuit that outputs the drive voltage corresponding to the predetermined gray scale value to the data lines, the drive circuit outputting the drive voltage to the data lines based on the OFF data output control signals during the second frame period, and outputting a non-display voltage to the data lines after the second frame period ends, the scan control signal being output to a scan driver that scans scan lines of the display panel, and the scan driver outputting a selecting voltage to the scan lines, and scanning the scan lines based on the scan control signal during a first frame period of the first frame and the second frame period, and outputting a non-selecting voltage to all of the scan lines after the second frame period ends, and the data driver and the scan driver being set to a sleep mode when a predetermined frame period elapsed after the second frame period ends if the display stopping signal is a sleep signal.

6. The data driver according to claim 5, the display stopping signal being at least one of:

an initializing signal for the data driver; and the sleep signal that sets a sleep state;

in which drive for the data lines is stopped.

7. The data driver according to claim 5, the drive voltage corresponding to the predetermined gray scale value being a drive voltage corresponding to a gray scale value of 0.

8. A display drive method for a display system, comprising:

an active matrix type display panel;

a data driver that drives data lines of the display panel; and a scan driver that scans scan lines of the display panel, the data driver outputting a drive voltage corresponding to a predetermined gray scale value to the data lines during a second frame period that includes a second and subsequent frames, the second frame being the next frame after a first frame where a display stopping signal is input, when the display stopping signal for stopping an image display of the display panel is input, and the scan driver outputting a selecting voltage to the scan lines, and scanning the scan lines during a first frame period of the first frame and the second frame period, and the data driver outputting a non-display voltage to the data lines after the second frame period ends, while the scan driver outputs a non-selecting voltage to all of the scan lines after the second frame period ends, and the data driver and the scan driver being set to a sleep mode when a predetermined frame period elapsed after the second frame period ends if the display stopping signal is a sleep signal.

9. The display system according to claim 1, the display stopping signal being at least one of:

an initializing signal for the data driver; and the sleep signal that sets a sleep state;

in which drive for the data lines is stopped.

10. The display system according to claim 1, a drive voltage corresponding to the predetermined gray scale value being a drive voltage corresponding to a gray scale value of 0.

* * * * *